US009440123B2

(12) United States Patent
Beno et al.

(10) Patent No.: US 9,440,123 B2
(45) **Date of Patent: *Sep. 13, 2016**

(54) GOLF CLUB HEAD WITH ACCESSIBLE INTERIOR

(71) Applicant: Cobra Golf Incorporated, Carlsbad, CA (US)

(72) Inventors: Tim A. Beno, San Diego, CA (US); Karl Clausen, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/455,483

(22) Filed: Aug. 8, 2014

(65) Prior Publication Data

US 2014/0349777 A1 Nov. 27, 2014

Related U.S. Application Data

(63) Continuation-in-part of application No. 14/258,694, filed on Apr. 22, 2014, which is a continuation-in-part of application No. 14/150,035, filed on Jan. 8, 2014, which is a continuation-in-part of application No.

(Continued)

(51) Int. Cl.
*A63B 53/04* (2015.01)
*A63B 53/06* (2015.01)
(Continued)

(52) U.S. Cl.
CPC ..... *A63B 53/0466* (2013.01); *A63B 53/0475* (2013.01); *A63B 53/06* (2013.01);
(Continued)

(58) Field of Classification Search
CPC ..... A63B 53/0475; A63B 53/06; A63B 2207/02; A63B 2053/045; A63B 2053/0433; A63B 2053/0416; A63B 49/06; A63B 2209/00; A63B 2053/0491; A63B 53/0466; A63B 59/0074; A63B 2053/0437; A63B 2071/0694; A63B 2059/0003; A63B 59/0092; A63B 53/02; A63B 2209/10; A63B 2209/08; A63B 60/42; A63B 60/52; A63B 2060/002; A63B 60/54
USPC ..... 473/287–292, 324–350
See application file for complete search history.

(56) References Cited

U.S. PATENT DOCUMENTS 713,845 A 11/1902 Braid
1,253,700 A 1/1918 Mclaughlin
(Continued)

FOREIGN PATENT DOCUMENTS

JP 8-089603 A 4/1996
JP 9-192269 A 7/1997
(Continued)

OTHER PUBLICATIONS

European Search Report for EP Appl. No. 10013627 4-2318 of Mar. 11, 2011 (8 pages).
(Continued)

*Primary Examiner* — Sebastiano Passaniti
(74) *Attorney, Agent, or Firm* — Brown Rudnick LLP; Mark S. Leonardo

(57) ABSTRACT

The invention provides a golf club head having a port for providing a view into the interior cavity of the club head. The club head further includes at least one rib positioned along an internal surface of the club head and adjacent to the port. The at least one rib is configured to provide sound tuning characteristics, increasing the frequency of the port, thereby improving acoustic properties of the club head, particularly the sound produced by the golf club head during ball impact.

17 Claims, 30 Drawing Sheets

Related U.S. Application Data

13/545,329, filed on Jul. 10, 2012, now abandoned, which is a continuation-in-part of application No. 13/539,958, filed on Jul. 2, 2012, said application No. 13/545,329 is a continuation-in-part of application No. 13/407,087, filed on Feb. 28, 2012, now abandoned, which is a continuation-in-part of application No. 12/643,154, filed on Dec. 21, 2009, now Pat. No. 8,147,354, said application No. 13/545,329 is a continuation-in-part of application No. 13/185,324, filed on Jul. 18, 2011, now Pat. No. 8,226,499, which is a continuation of application No. 12/696,468, filed on Jan. 29, 2010, now Pat. No. 7,980,964, which is a continuation of application No. 11/110,733, filed on Apr. 21, 2005, now Pat. No. 7,658,686.

(60) Provisional application No. 61/513,509, filed on Jul. 29, 2011.

(51) Int. Cl.
*A63B 71/06* (2006.01)
*A63B 53/02* (2015.01)

(52) U.S. Cl.
CPC ..... *A63B 60/42* (2015.10); *A63B 53/02* (2013.01); *A63B 60/52* (2015.10); *A63B 60/54* (2015.10); *A63B 2053/045* (2013.01); *A63B 2053/0416* (2013.01); *A63B 2053/0433* (2013.01); *A63B 2053/0437* (2013.01); *A63B 2053/0491* (2013.01); *A63B 2060/002* (2015.10); *A63B 2071/0694* (2013.01); *A63B 2207/02* (2013.01); *A63B 2209/00* (2013.01); *A63B 2209/08* (2013.01); *A63B 2209/10* (2013.01)

(56) References Cited

U.S. PATENT DOCUMENTS 1,349,806 A 8/1920 Booth
1,361,258 A 12/1920 Horton
1,412,650 A 4/1922 Booth
1,452,845 A 4/1923 Pryde
1,455,379 A 5/1923 Allen
1,552,297 A 9/1925 Harness
1,559,299 A 10/1925 Barach
1,574,213 A 2/1926 Tyler
1,575,364 A 3/1926 Hodgkins
1,665,523 A 4/1928 Boyce
1,705,997 A 3/1929 Williams
1,879,117 A 9/1932 Davidson
2,076,340 A 4/1937 William
2,163,091 A 6/1939 Held
2,171,383 A 8/1939 Wettlaufer
3,096,982 A 7/1963 Bassin
3,166,320 A 1/1965 Onions
3,524,646 A 8/1970 Wheeler
3,556,533 A 1/1971 Hollis
3,640,534 A 2/1972 Mills
3,692,306 A 9/1972 Glover
3,941,390 A 3/1976 Hussey
3,966,210 A 6/1976 Rozmus
D240,644 S 7/1976 Manfrin
3,979,123 A 9/1976 Belmont
3,985,363 A 10/1976 Jepson et al.
4,021,047 A 5/1977 Mader
4,043,563 A 8/1977 Churchward
4,052,075 A 10/1977 Daly
4,063,737 A 12/1977 Tom et al.
4,067,572 A 1/1978 Coleman
4,085,934 A 4/1978 Churchward
4,193,601 A 3/1980 Reid, Jr. et al.
4,194,739 A 3/1980 Thompson
D262,049 S 11/1981 Simmons
4,313,607 A 2/1982 Thompson
4,325,553 A 4/1982 Taylor
4,340,230 A 7/1982 Churchward
4,432,549 A 2/1984 Zebelean
4,438,931 A 3/1984 Motomiya
4,653,756 A 3/1987 Sato
4,762,322 A 8/1988 Molitor et al.
4,767,298 A 8/1988 Bocchicchio et al.
4,792,140 A 12/1988 Yamaguchi et al.
4,869,507 A 9/1989 Sahm
4,872,683 A 10/1989 Doran et al.
4,872,685 A 10/1989 Sun
4,883,275 A 11/1989 Boone
4,895,371 A 1/1990 Bushner
4,930,781 A 6/1990 Allen
5,039,098 A 8/1991 Pelz
5,050,879 A 9/1991 Sun et al.
5,186,465 A 2/1993 Chorne
5,205,560 A 4/1993 Hoshi et al.
5,213,328 A 5/1993 Long et al.
5,255,913 A 10/1993 Tsuchida
5,272,802 A 12/1993 Stites, III
5,294,037 A 3/1994 Schmidt
5,310,186 A 5/1994 Karsten
5,328,176 A 7/1994 Lo
5,346,217 A 9/1994 Tsuchiya et al.
5,388,827 A 2/1995 Reynolds, Jr.
5,429,365 A 7/1995 McKeighen
5,433,442 A 7/1995 Walker
5,435,558 A 7/1995 Iriarte
5,447,309 A 9/1995 Vincent
5,464,216 A 11/1995 Hoshi et al.
5,474,297 A 12/1995 Levin
5,482,281 A 1/1996 Anderson
5,484,155 A 1/1996 Yamawaki et al.
5,509,660 A 4/1996 Elmer
5,518,240 A 5/1996 Igarashi
5,518,243 A 5/1996 Redman
5,540,435 A 7/1996 Kawasaki
5,547,188 A 8/1996 Dumontier et al.
5,582,553 A 12/1996 Ashcraft et al.
5,586,944 A 12/1996 Nagamoto et al.
5,620,378 A 4/1997 Fritz et al.
5,624,331 A 4/1997 Lo et al.
5,665,014 A 9/1997 Sanford et al.
5,683,309 A 11/1997 Reimers
5,769,736 A 6/1998 Sato
5,776,011 A 7/1998 Su et al.
5,785,609 A 7/1998 Sheets et al.
5,788,587 A 8/1998 Tseng
5,797,176 A 8/1998 Rose et al.
5,807,188 A 9/1998 Serrano et al.
5,816,927 A 10/1998 Taylor
5,842,935 A 12/1998 Nelson
5,871,784 A 2/1999 Assink et al.
5,911,638 A 6/1999 Parente et al.
5,916,042 A 6/1999 Reimers
5,935,020 A 8/1999 Stites et al.
5,947,840 A 9/1999 Ryan
5,971,867 A 10/1999 Galy
5,997,415 A * 12/1999 Wood ..... A63B 53/04 473/346
D418,885 S 1/2000 Wanchena
6,012,989 A 1/2000 Saksun, Sr.
6,033,318 A 3/2000 Drajan, Jr. et al.
6,059,669 A 5/2000 Pearce
6,074,308 A 6/2000 Domas
6,077,171 A 6/2000 Yoneyama
6,089,994 A 7/2000 Sun
6,102,813 A 8/2000 Dill
6,123,627 A 9/2000 Antonious
6,139,446 A 10/2000 Wanchena
6,149,534 A 11/2000 Peters et al.
6,162,133 A 12/2000 Peterson
6,183,377 B1 2/2001 Liang
6,217,461 B1 4/2001 Galy
6,248,025 B1 6/2001 Murphy et al.
6,248,026 B1 6/2001 Wanchena

(56) References Cited

U.S. PATENT DOCUMENTS 6,254,494 B1 7/2001 Hasebe et al.
6,277,032 B1 8/2001 Smith
6,296,470 B1 10/2001 Lanser et al.
6,306,048 B1 10/2001 McCabe et al.
6,332,848 B1 12/2001 Long et al.
6,340,337 B2 1/2002 Hasebe et al.
6,354,962 B1 3/2002 Galloway et al.
6,354,963 B1 3/2002 Kodama et al.
6,379,265 B1 4/2002 Hirakawa et al.
6,409,612 B1 6/2002 Evans et al.
6,422,951 B1 7/2002 Burrows
6,440,009 B1 8/2002 Guibaud et al.
6,442,951 B1 9/2002 Maeda et al.
6,471,604 B2 10/2002 Hocknell et al.
6,482,106 B2 11/2002 Saso
6,514,154 B1 2/2003 Finn
6,547,673 B2 4/2003 Roark
6,558,271 B1 * 5/2003 Beach ..... A63B 53/04 473/327
6,565,425 B1 5/2003 Wuensch
6,565,452 B2 5/2003 Helmstetter et al.
6,572,491 B2 6/2003 Hasebe et al.
6,575,845 B2 6/2003 Galloway et al.
6,592,468 B2 7/2003 Vincent et al.
6,602,149 B1 8/2003 Jacobson
6,623,378 B2 9/2003 Beach et al.
6,645,086 B1 11/2003 Chen
6,648,773 B1 11/2003 Evans
6,695,608 B2 2/2004 Murphy et al.
6,716,114 B2 4/2004 Nishio
6,739,982 B2 5/2004 Murphy et al.
6,739,983 B2 5/2004 Helmstetter et al.
6,739,984 B1 5/2004 Ciasullo
6,769,996 B2 8/2004 Tseng
6,773,360 B2 8/2004 Willett et al.
6,776,723 B2 8/2004 Bliss et al.
6,840,755 B1 1/2005 Cook
6,860,818 B2 3/2005 Mahaffey
6,860,823 B2 3/2005 Lee
6,863,620 B2 3/2005 Tucker, Sr.
6,872,152 B2 3/2005 Beach et al.
6,890,267 B2 5/2005 Mahaffey et al.
6,896,625 B2 5/2005 Grace
6,902,497 B2 6/2005 Deshmukh et al.
6,913,542 B1 7/2005 Hu et al.
6,913,546 B2 7/2005 Kakiuchi
6,926,615 B1 8/2005 Souza et al.
6,929,565 B2 8/2005 Nakahara et al.
6,932,875 B2 8/2005 Cheng et al.
6,955,612 B2 10/2005 Lu
6,988,956 B2 1/2006 Cover et al.
6,991,555 B2 1/2006 Reese
6,991,558 B2 1/2006 Beach et al.
7,004,852 B2 2/2006 Billings
7,008,332 B2 3/2006 Liou
7,022,030 B2 4/2006 Best et al.
7,025,692 B2 4/2006 Erickson et al.
7,041,005 B2 5/2006 Beach et al.
7,063,629 B2 6/2006 Nakahara et al.
7,070,517 B2 7/2006 Cackett et al.
7,094,159 B2 8/2006 Takeda
7,108,609 B2 9/2006 Stites et al.
7,128,664 B2 10/2006 Onoda et al.
7,140,974 B2 11/2006 Chao et al.
7,147,573 B2 12/2006 DiMarco
7,156,752 B1 1/2007 Bennett
7,160,040 B2 1/2007 Matsushima
7,163,468 B2 1/2007 Gibbs et al.
7,166,038 B2 1/2007 Williams et al.
7,166,040 B2 1/2007 Hoffman et al.
7,169,060 B2 1/2007 Stevens et al.
7,175,541 B2 * 2/2007 Lo ..... A63B 53/0466 273/DIG. 14
7,186,190 B1 3/2007 Beach et al.
7,204,768 B2 4/2007 Nakahara et al.
7,217,199 B2 5/2007 Nakahara et al.
7,244,188 B2 7/2007 Best
7,252,599 B2 8/2007 Hasegawa
7,258,624 B2 * 8/2007 Kobayashi ..... A63B 53/04 473/324
7,258,625 B2 8/2007 Kawaguchi et al.
7,281,993 B2 10/2007 Oyama
7,297,072 B2 11/2007 Meyer et al.
7,303,487 B2 12/2007 Kumamoto
7,338,390 B2 3/2008 Lindsay
D567,888 S 4/2008 Soracco
7,371,191 B2 5/2008 Sugimoto
7,377,860 B2 5/2008 Breier et al.
7,419,441 B2 * 9/2008 Hoffman ..... A63B 53/0466 473/334
7,491,131 B2 2/2009 Vinton
7,524,149 B2 4/2009 Heule et al.
7,524,249 B2 4/2009 Breier et al.
7,530,901 B2 5/2009 Imamoto et al.
7,549,933 B2 6/2009 Kumamoto
7,566,279 B2 7/2009 Nakashima
7,625,298 B2 12/2009 Bennett
7,632,195 B2 12/2009 Jorgensen
7,658,686 B2 2/2010 Soracco
7,753,809 B2 7/2010 Cackett et al.
7,758,451 B2 7/2010 Liang et al.
7,771,290 B2 8/2010 Bezilla et al.
7,789,766 B2 9/2010 Morris et al.
7,803,065 B2 9/2010 Breier et al.
7,806,782 B2 10/2010 Stites et al.
7,819,754 B2 10/2010 Evans et al.
7,854,665 B2 * 12/2010 Dewhurst ..... A63B 53/0466 473/329
7,938,740 B2 5/2011 Breier et al.
7,959,522 B2 6/2011 North, III et al.
7,980,964 B2 7/2011 Soracco
8,007,371 B2 8/2011 Breier et al.
8,033,930 B2 10/2011 Tavares et al.
8,038,545 B2 10/2011 Soracco
8,057,323 B2 11/2011 Liang et al.
8,062,151 B2 11/2011 Boyd et al.
8,133,128 B2 3/2012 Boyd et al.
8,133,129 B2 3/2012 Boyd et al.
8,162,776 B2 4/2012 Boyd et al.
8,206,243 B2 6/2012 Stites
8,303,433 B2 11/2012 Roach et al.
8,337,319 B2 * 12/2012 Sargent ..... A63B 53/02 473/246
8,376,873 B2 2/2013 Golden et al.
8,435,135 B2 5/2013 Stites et al.
8,523,705 B2 9/2013 Breier et al.
8,585,514 B2 11/2013 Boyd et al.
8,834,294 B1 9/2014 Seluga et al.
9,067,110 B1 * 6/2015 Seluga ..... A63B 53/06
2001/0001302 A1 5/2001 Murphy et al.
2001/0049310 A1 12/2001 Cheng et al.
2002/0045490 A1 4/2002 Ezawa et al.
2002/0077195 A1 6/2002 Carr et al.
2002/0137576 A1 9/2002 Dammen
2002/0160858 A1 10/2002 Lee
2003/0045371 A1 3/2003 Wood et al.
2003/0100381 A1 5/2003 Murphy et al.
2003/0130059 A1 7/2003 Billings
2003/0134690 A1 7/2003 Chen
2003/0134693 A1 7/2003 Nakahara et al.
2003/0144078 A1 7/2003 Setokawa et al.
2003/0162608 A1 8/2003 Chen
2004/0116207 A1 6/2004 De Shiell et al.
2004/0116208 A1 6/2004 De Shiell et al.
2004/0138002 A1 7/2004 Murray
2004/0176177 A1 9/2004 Mahaffey et al.
2004/0192468 A1 9/2004 Onoda et al.
2004/0224790 A1 11/2004 Lu
2004/0242343 A1 12/2004 Chao et al.
2004/0254030 A1 12/2004 Nishitani et al.
2005/0026723 A1 2/2005 Kumamoto
2005/0090330 A1 4/2005 Kumamoto
2005/0101408 A1 5/2005 Sanchez et al.
2005/0119070 A1 6/2005 Kumamoto

(56) References Cited

U.S. PATENT DOCUMENTS

| | | | |
|---|---|---|---|
| 2005/0159243 | A1 | 7/2005 | Chuang |
| 2005/0170907 | A1 | 8/2005 | Saso |
| 2005/0215354 | A1 | 9/2005 | Kumamoto |
| 2005/0272527 | A1 | 12/2005 | Sugimoto |
| 2006/0014592 | A1 | 1/2006 | Sugimoto |
| 2006/0052177 | A1 | 3/2006 | Nakahara et al. |
| 2006/0052181 | A1 | 3/2006 | Serrano et al. |
| 2006/0084525 | A1 | 4/2006 | Imamoto et al. |
| 2006/0100032 | A1 | 5/2006 | Imamoto et al. |
| 2006/0105855 | A1 | 5/2006 | Cackett et al. |
| 2006/0116218 | A1 | 6/2006 | Burnett et al. |
| 2006/0240907 | A1 | 10/2006 | Latiri |
| 2007/0054751 | A1 | 3/2007 | Breier et al. |
| 2007/0060414 | A1 | 3/2007 | Breier et al. |
| 2007/0249432 | A1 | 10/2007 | Wu |
| 2007/0265109 | A1 | 11/2007 | Elmer |
| 2008/0070721 | A1 | 3/2008 | Chen et al. |
| 2008/0102975 | A1 | 5/2008 | Chen |
| 2008/0102978 | A1 | 5/2008 | Burnett et al. |
| 2008/0227564 | A1 | 9/2008 | Breier et al. |
| 2008/0230948 | A1 | 9/2008 | Salvador et al. |
| 2008/0242445 | A1 | 10/2008 | Mergy et al. |
| 2008/0261715 | A1 | 10/2008 | Carter |
| 2008/0268980 | A1 | 10/2008 | Breier et al. |
| 2008/0293510 | A1 | 11/2008 | Yamamoto |
| 2009/0105010 | A1 | 4/2009 | De La Cruz et al. |
| 2009/0118034 | A1 | 5/2009 | Yokota |
| 2009/0186717 | A1 | 7/2009 | Stites et al. |
| 2009/0203465 | A1 | 8/2009 | Stites et al. |
| 2010/0041490 | A1 | 2/2010 | Boyd et al. |
| 2010/0041493 | A1 | 2/2010 | Clausen et al. |
| 2010/0041495 | A1 | 2/2010 | North, III et al. |
| 2010/0105499 | A1 | 4/2010 | Roach et al. |
| 2010/0130304 | A1 | 5/2010 | Soracco |
| 2010/0130305 | A1 | 5/2010 | Soracco |
| 2010/0160091 | A1 | 6/2010 | Boyd et al. |
| 2010/0261543 | A1 | 10/2010 | Breier et al. |
| 2010/0331103 | A1 | 12/2010 | Takahashi et al. |
| 2011/0021282 | A1 | 1/2011 | Sander |
| 2011/0045921 | A1 | 2/2011 | Evans |
| 2011/0053706 | A1 | 3/2011 | Breier et al. |
| 2011/0081986 | A1 | 4/2011 | Stites |
| 2011/0098128 | A1 | 4/2011 | Clausen et al. |
| 2011/0111885 | A1 | 5/2011 | Golden et al. |
| 2011/0159986 | A1 | 6/2011 | Chao et al. |
| 2011/0207547 | A1 | 8/2011 | Sander et al. |
| 2011/0312437 | A1* | 12/2011 | Sargent ..... A63B 53/02 473/335 |
| 2012/0064991 | A1 | 3/2012 | Evans |
| 2012/0129621 | A1 | 5/2012 | Boyd et al. |
| 2013/0178306 | A1 | 7/2013 | Beno et al. |

FOREIGN PATENT DOCUMENTS

| | | | |
|---|---|---|---|
| JP | 2000-024149 | A | 1/2000 |
| JP | 2002-336389 | A | 11/2002 |
| JP | 2003-093554 | A | 4/2003 |
| JP | 2003-310808 | A | 11/2003 |
| JP | 2004-121744 | A | 4/2004 |
| JP | 2004-159680 | A | 6/2004 |
| JP | 2004-337327 | A | 12/2004 |
| JP | 2006-25929 | | 2/2006 |
| JP | 2006-025929 | A | 2/2006 |
| JP | 2006-130065 | A | 5/2006 |
| WO | 2004/052472 | A1 | 6/2004 |
| WO | 2007/101350 | A1 | 9/2007 |

OTHER PUBLICATIONS

European Search Report for European Application No. 10013627.4-2318, dated Mar. 11, 2011, in 8 pages.

Japanese Office Action titled Pretrial Reexamination Report for Japanese Application No. 2007-085624, (Appeal Trial No. 2010-009497), dated Jul. 7, 2010, in 6 pages.

Japanese Office Action for JP Appl. 2007-311561 of Jun. 30, 2010 (7 pages).

Japanese Office Action for JP Appl. 2007-085624 of Jul. 7, 2010 (6 pages).

Jackson, Jeff, The Modern Guide to Golf Clubmaking, Ohio: Dynacraft Golf Products, Inc. copyright 1994, p. 239.

Japanese Office Action for Application No. 2007-311561, dated Jun. 30, 2010, in 7 pages.

Jackson, J., the Modem Guide to Golf Clubmaking, p. 239, Dynacraft, Ohio (3 pp.).

* cited by examiner

A-A

Moveable Weight - 19 gms, Crown Weight 19.5 gms., 209 gm. Head

| | MOI | CG_x | CG_y | CG_na |
|---|---|---|---|---|
| Heel | 4545 | 4.5 | 31 | 1.7 |
| Center | 4241 | 0.3 | 31 | 0.5 |
| Toe | 4456 | -2.7 | 31 | 1.3 |

GOLF CLUB HEAD WITH ACCESSIBLE INTERIOR

CROSS-REFERENCE TO RELATED APPLICATIONS

This application is a continuation-in-part of U.S. patent application Ser. No. 14/258,694, filed Apr. 22, 2014, which is a continuation-in-part of U.S. patent application Ser. No. 14/150,035, filed Jan. 8, 2014, which is a continuation-in-part of U.S. patent application Ser. No. 13/545,329, filed Jul. 10, 2012, which is a continuation-in-part of U.S. patent application Ser. No. 13/185,324, filed Jul. 18, 2011, which is a continuation of U.S. patent application Ser. No. 12/696,468, filed Jan. 29, 2010, which is a continuation of U.S. patent application Ser. No. 11/110,733 to Soracco, filed Apr. 21, 2005.

U.S. patent application Ser. No. 13/545,329, filed Jul. 10, 2012, is also a continuation-in-part of U.S. patent application Ser. No. 13/539,958, filed Jul. 2, 2012, which is a non-provisional of U.S. Provisional Application Ser. No. 61/513,509, filed Jul. 29, 2011.

U.S. patent application Ser. No. 13/545,329 is also a continuation-in-part of U.S. patent application Ser. No. 13/407,087, filed Feb. 28, 2012, which is a continuation-in-part of U.S. patent application Ser. No. 12/643,154, filed Dec. 21, 2009.

FIELD OF THE INVENTION

The invention relates to a golf club head with an accessible interior.

BACKGROUND

The complexities of golf club design are known. The specifications for each component of the club (i.e., the club head, shaft, grip, and subcomponents thereof) directly impact the performance of the club. Thus, by varying design specifications, a golf club can be tailored to have specific performance characteristics. Among the more prominent considerations in club head design are loft, lie, face angle, horizontal face bulge, vertical face roll, center of gravity, rotational moment of inertia, material selection, overall head size, and overall head weight.

Golfers need golf clubs that can be used to hit the ball the right distance in the intended direction and enjoy the game more when the golf clubs have been customized and personalized to match their abilities and preferences. There have been attempts to offer golfers the ability to adjust and customize their golf clubs. Some attempts include adjustable weight systems, adjustable loft or lie angles, means to attenuate sound, and personalization. Those clubs are fraught with problems because the adjustment mechanisms interfere with aerodynamics, collect dirt and grime, have small parts that break when they hit the ground during use, and are difficult to use.

Some attempts have been made to put weights inside of golf clubs. For example, U.S. Pub. 2008/0261715 to Carter shows a golf club head with tracks and weights. U.S. Pat. No. 8,206,243 to Stites reports a moveable weight member in a golf club head. U.S. Pub. 2013/0260913 to Beach shows a club head with a track with a weight. U.S. Pub. 2013/0296070 to Stites shows a club head with face-aft weight slot in the sole. There have further been attempts to provide removable covers for providing access to the club interior for placement of weight inside the golf club. For example, U.S. Pat. No. 8,491,413 to Billings reports a hollow-body golf club head with a removable weighting port providing access the interior of the club head and placement of a weighting material. Unfortunately, some weight systems break during use. Furthermore, external adjustment mechanisms are complicated to use, fragile, and adversely affect inertial properties. Additionally, removable covers for providing access to the interior of the club head may have a negative effect on other club head performance characteristics, including the sound of the club head upon impact with the ball.

Another important aspect of club head design includes consideration of the sound created upon impact between the club head with a ball. Golfers have become accustomed to hearing a particular sound when the golf club impacts the golf ball, especially when a large volume golf club is used. This "ideal sound", although often a result of personal preference, can drastically turn into an unappealing sound if it varies too much from the above mentioned "ideal sound."

For example, as the size of golf club heads has increased, weight distribution has become a major design consideration. In particular, in the quest to design in additional discretionary mass, it has become desirable to decrease the wall thicknesses of the portions of the club head wall that do not improve mass properties. Additionally, composite materials have also been used in the past to replace various sections of the club head walls to further improve weight distribution and generate discretionary mass. Furthermore, some club heads include removable covers placed on different portions of the club head body, wherein the removable cover is generally flat and has a low inherent natural frequency. Because of the thin walls, composite materials, shapes/contours of removable covers, and/or the large volumes of the golf club head, large portions of the heads act as membranes and vibrate relative to each other. In some instances, the vibration that takes place could result in an unappealing sound during impact between the golf club and the golf ball.

SUMMARY

The invention provides a golf club head having a port including a window portion for providing a view into the interior cavity of the club head. The port may be permanently fixed to the club head or, in an alternative embodiment, the port may be removable, thereby allowing access to the interior of the club head. In some embodiments, a club head consistent with the present disclosure may include one or more features disposed within the interior cavity of the club head, including, but not limited to, a mass adjustment mechanism configured for adjusting a mass distribution of the club head body, a sound tuning member for adjusting sound properties of the club head, informative data provided in the form of a painting, marking, indicia, engraving, embossing, and decal, and one or more electronic devices positioned within the club head body for collecting information related to the club head body and/or club head performance. Accordingly, a port consistent with the present disclosure provides a golfer with view into the interior cavity, thereby allowing the golfer to see specific settings of the club (e.g., weight placement, sound tuning characteristics, etc.) without having to remove a portion of the club head in order to gain an internal view.

In certain embodiments, the invention provides a golf club head that includes a club head body including a heel, a toe, a sole, a crown, and a ball-striking face. The golf club head further includes a port coupled to a portion of the club head body, the port configured to provide a view from the exterior of the club head into an interior cavity of the club head body. The club head may be a hollow, wood-type golf club head and the club head body defines an enclosed interior volume.

In some embodiments, the golf club head further includes at least one rib positioned on an internal surface of the interior cavity of the club head and adjacent to the port. The at least one rib is configured to provide sound tuning characteristics for the golf club head. In one embodiment, the at least one rib is configured to increase a vibration frequency value of an area adjacent the port to improve an acoustic property of the club head, such as a sound produced by the golf club head during impact between the ball-striking face and a ball.

In certain aspects, the invention provides a golf club head with a club head body that includes a heel, a toe, a sole, a crown, and a ball-striking face. The club head further includes a port coupled to a mounting portion on the sole of the club head body. The port includes a body portion having an inner annular wall, an outer annular wall surrounding the inner annular wall, and at least one secondary rib extending between the inner and outer annular walls. The port further includes a window portion composed of a transparent or translucent material configured to provide a view from the exterior of the club head into an interior cavity of the club head body. The club head further includes at least two main ribs positioned on an internal surface of the sole and extending from the port towards a perimeter of the club head body.

In some embodiments, a first main rib extends from the port towards a portion of the face adjacent to the toe of the club head body and a second main rib extends from the port towards a portion of the face adjacent to the heel of the club head body. The first and second main ribs radiate from the outer annular wall of the port, defining an angle there between. The angle between the first and second main ribs is in the range of 10 degrees and 170 degrees, and more preferably in the range of 45 degrees and 135 degrees. In one embodiment, the angle between the first and second main ribs is 90 degrees. In some embodiments, at least one of the first and second main ribs is aligned with the at least one secondary rib of the port. The two main ribs are configured to provide sound tuning characteristics for the golf club head. The two main ribs are configured to specifically increase a vibration frequency value of an area adjacent the port to improve an acoustic property of the club head.

Aspects of the invention provide a club head including a port that provides a golfer with a view of the interior of the club head. Furthermore, in some embodiments, the port further provides access to the interior of the club head. The ability to provide an internal view and/or access is particularly beneficial in club heads having internally placed components and/or informative data. For example, providing a view to the interior of the club head allows a golfer to see the particular components within the club head, the specific settings of such components, and provide a general understanding of the performance characteristics of the club head, all without requiring the golfer to gain physical access in order to get an interior view, as would be the case with other club heads. Furthermore, access to the interior of the head may facilitate weight adjustment, sound adjustment, personalization, or other customization or adjustment schema.

DETAILED DESCRIPTION

Embodiments of the invention provide a golf club head that includes a club head body comprising a sole, a crown, a face, and a hosel, and in which an interior of the club head is accessible for adjustment. The club head is preferably a hollow, wood-type club head that is accessible by means of an opening mechanism.

Figure 1:
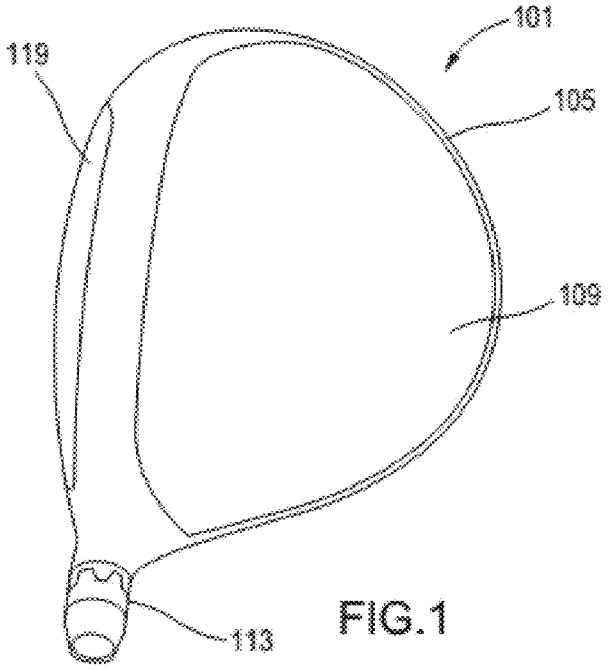
FIG. 1 shows a club head of the present invention.

FIG. 1 shows a club head 101 of the present invention. Club head 101 includes a club head body 105 with a sole, crown, face 119, and hosel 113 and has an accessible interior via openable second body member 109. In the depicted embodiment, second body member 109 has an area greater than about 3 $cm^2$. This means that the opening mechanism, when open, provides an aperture giving access into an interior volume of the club head body that is enclosed when the opening mechanism is closed, wherein the aperture has an open area of at least 3 $cm^2$.

In certain embodiments, openable second body member 109 is provided as a removable component. That is, the club head body comprises a first body member 105 comprising a portion of the sole, the hosel, and the face, the first body member having an attachment perimeter defining an opening and a second body member 109 coupled to the attachment perimeter to enclose the opening. Any suitable portion of club head 101 may be removable. For example, removable component 109 may be a panel of the sole, the entire sole, an aft body, a crown panel, or other. As shown in FIG. 1, removable panel 109 is a crown portion of club head 101. Club head 101 includes a mechanism to fasten removable panel 109 in place.

In certain embodiments, club head 101 also includes a mass adjustment mechanism inside of the club head body configured for adjusting a mass distribution of the club head body. Club head 101 may be any type of club head such as any wood-type or hybrid-type club head, i.e., a hollow, wood-type golf club head and the club head body defines an enclosed interior volume. Preferably, the mass adjustment mechanism is disposed within the enclosed interior volume. Generally, club head 101 will include a club head body 105 defining an overall shape of the head. Club head 101 will generally include a ball-striking face 119 and a hosel 113.

Figure 2:
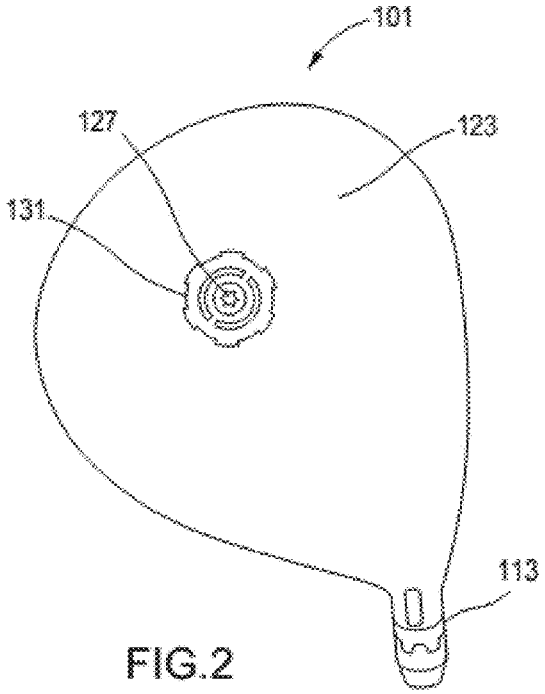
FIG. 2 shows a sole of a club head according to some embodiments.

FIG. 2 shows a sole 123 of club head 101 according to some embodiments. Visible on sole 123 is fastening mechanism 131 having a mechanical fastener fastened therein, such as, for example, a screw 127. Screw 127 (or any other suitable fastener such as a barbed post, a cotter pin, or other binder) is accessible from an exterior of club head 101. When screw 127 is in place, removable component 109 is held in place and club head 101 can be used in playing golf. A golfer can use a tool, such as a specialty tool with a custom tip, to unfasten screw 127 via a tool interface surface, such as a shaped recessed tool port. A golfer can unscrew screw 127 and release it, thereby releasing removable component 109.

Figure 3:
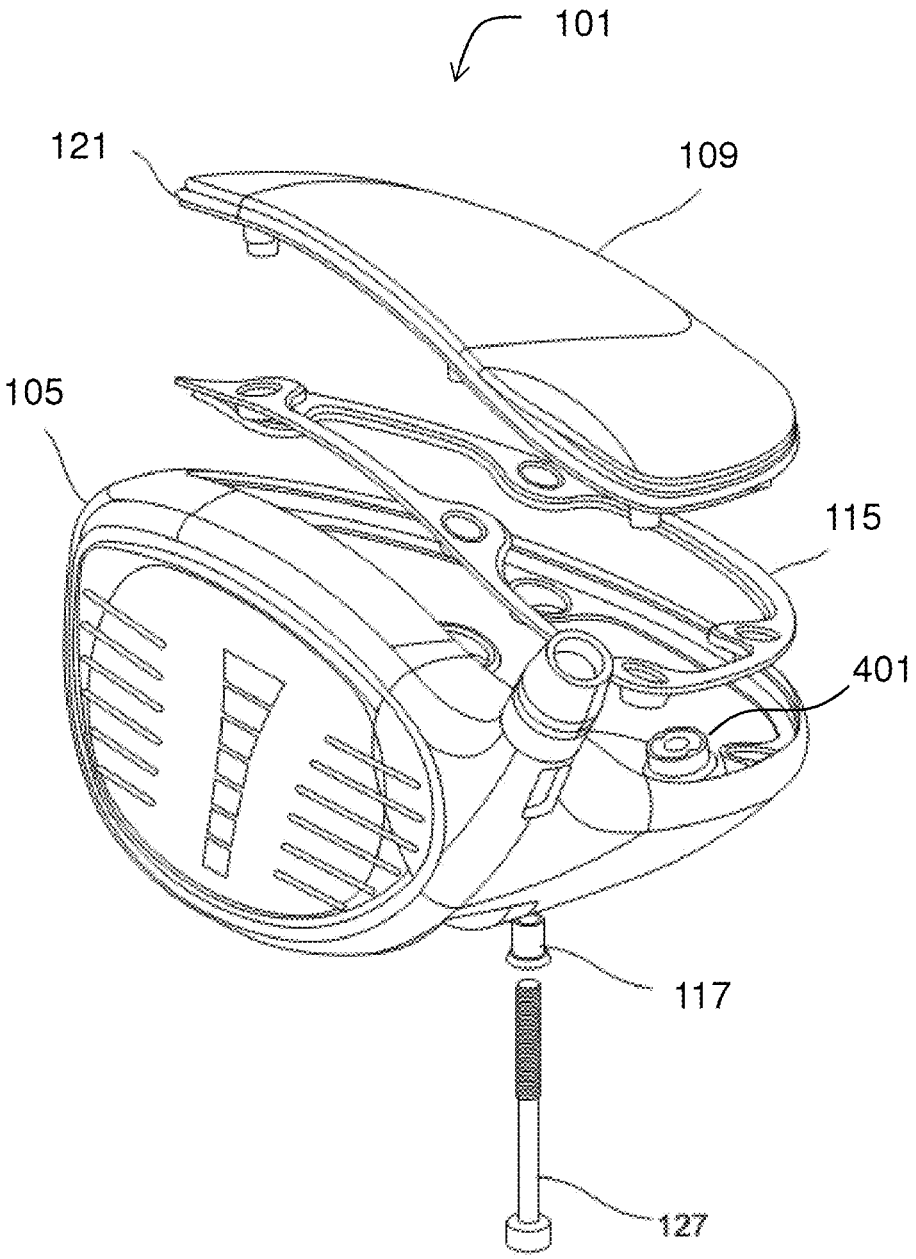
FIG. 3 shows an exploded view of a golf club head according to some embodiments.

FIG. 3 shows an exploded view of a golf club head 101 according to some embodiments with an openable component 109. As depicted in FIG. 3, openable component 109 provides an opening mechanism that includes a portion of the club head that is configured to be removed from, and re-attached to, the club head body. In some embodiments, the removable portion attaches to the club head body via at least one mechanical fastener such as, for example, a screw 127. It should be noted that the mechanical fastener for securing the removable component 109 in place may include a variety of different types of fasteners and is not limited to a screw. For example, in other embodiments, the mechanical fastener may include, but is not limited to, a bolt, a flared tab, a hook-and-loop fastener, a rivet, a semi-permanent adhesive, an interference fit fastener, a cam lock fastener, a spring-loaded fastener, and other suitable fasteners.

Additionally, removable component 109 may sit on gasket 115 which may be glued to the club head body 105 (e.g., titanium). Assembly screw 127 is seated within club head body 105 through the use of a shoulder member 117 (e.g., Ti, Al, PTFE, carbon fiber, etc.). Screw 127 may be held in the place through a rubber washer or similar mechanism. O-ring 121 extends around a perimeter of removable crown 109. As illustrated by FIG. 3, aspects of the invention provide a club head that gives access to an interior of the club head. The club head may include a panel that opens or is removable, or the club head may be designed and configured for disassembly and reassembly to provide access to the interior. Access to the interior of the head may facilitate weight adjustment, sound adjustment, personalization, or other customization or adjustment schema. Club head 101 includes a mass adjustment mechanism that here includes a weight mount point 401 on an inside surface of the club head.

In one embodiment, a club head includes a rib member attached with various mount points such as weld beads and the removal of certain mount points or portions of the rib member can be done to alter the sound of the club head. For example, a metal rib may extend across at least part of an inside surface of a sole of the club head. The rib may be welded at a plurality of points, aka weld beads (e.g., there may be 3, or 5, or 7, or 50, or any number, of weld points). A golfer (or a consultant in a pro shop) may snap off some of the weld beads to tune a sound of the rib according to the golfer. A golfer may perform best if the sound is tailored to their particular, personal hearing range or sensitivities. In certain embodiments, the club head includes a sound tuning member such as a rib that can be repositioned internally for sound tuning. To give one example, a sound tuning member can attach via the system discussed with respect to FIGS. 12 & 13 below. Moreover, an inside surface of the club head can include markings to guide the location of the sound tuning member to aid a golfer in obtaining a desired sound quality.

In some embodiments, access to the interior of the club head opens up the interior of the club head as a medium for communication through the inclusion of information such as printing, indicia, markings or colorings, etc. A golfer may personalize their club within the interior. For example, personalization could include someone adding a motivational slogan or their initials to identify their club. An inside surface of the club head can be personalized by any suitable method such as painting, engraving, decals, a slot for holding a printed card, etc.

In some embodiments, access to the interior of the club head further allows insertion and/or removal of an electronic device within the interior of the club head. The electronic device may be configured to capture a variety of information related to the club and club performance, such as, for example, club type and club settings, impact of ball with the face of the club, angle of impact, rotation of club in downward and upward swing, etc. In certain embodiments, the electronic device may include a battery, solenoid, sensors (motion sensor, accelerometers, gyroscopes, magnetometers, switches, or other electric or mechanical device, or a combination thereof). Accordingly, the device may be configured to detect or measure motion of the club in any one of, or any combination of, numerous modes including acceleration, translation motions, vibration, shock, tilt, and rotation. The device may also include an RFID tag or other device. An RFID tag can be used to uniquely identify the club (or the player, golf course, club set, manufacturer, etc.) to an electronic device and thus to support information gathering for a game improvement program. Exemplary systems and devices for collecting and analyzing data are discussed in GOLF CLUB WITH ELECTRONIC DEVICE, U.S. patent application Ser. No. 14/102,866 to Tim Beno, et al., filed Dec. 11, 2013, and GOLF CLUB GRIP WITH DEVICE HOUSING, U.S. patent application Ser. No. 13/946,543 to Tim Beno, et al., filed Jul. 19, 2013, the contents of each of which are hereby incorporated by reference in their entirety.

The electronic device can be configured to communicate with other electronic devices. For example, the electronic device can include wireless communication means such as a 3G or 4G cell antenna, Bluetooth, RFID tag, or a Wi-Fi card. A chip on device can communicate, directly or via a network, with another electronic device that offers some functionality to a golfer. For example, device can communicate with a smartphone, a tablet computer, a laptop, or any other computing device. Data collected by device can be transmitted to another electronic device for further storage or processing.

In some embodiments, the invention provides software for processing data captured by device. Software can be an app that a golfer downloads onto a device, an application that a golfer installs onto a computing device, one or more programs that run on a web server accessible, for example, via a web page, or any combination thereof. By installing the golf-data analyzing software or running it in the memory of a computer device, including a memory coupled to processor, the processor can execute one or more programs to analyze data related to the playing of golf. Analysis includes displaying, comparing, and calculating (e.g., taking an average or interpolating a trend).

A game improvement program can be administered using electronic devices as well as computer systems and computer program-based analytical tools. Thus, using devices and methods of the invention, a golfer can gather information during their game and use that information to analyze their performance or to enhance their enjoyment of the game by, for example, competing electronically with their friends, comparing their performance to a pro's, or documenting their performance over time. Exemplary systems and methods for improving performance to enhance enjoyment of golf by data collection are discussed in Systems and Methods for Communication Sports-Related Information, U.S. Pub. 2012/0316843, Method and System for Athletic Motion Analysis and Instruction, U.S. Pub. 2007/0270214, and Method and System for Athletic Motion Analysis and Instruction, U.S. Pub. 2006/0166737, the contents of each of which are hereby incorporated by reference in their entirety.

Figure 4:
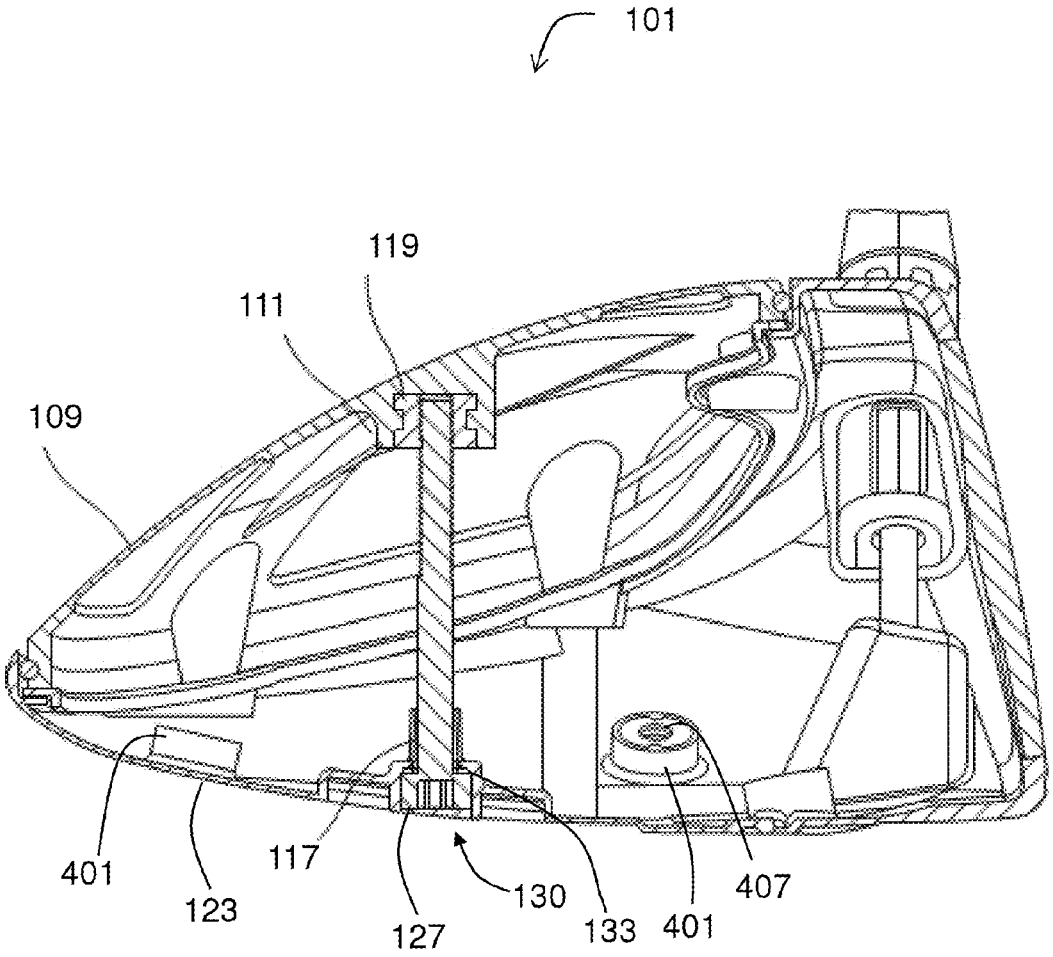
FIG. 4 shows a cutaway view through a club head.

FIG. 4 shows a cutaway view through club head 101. As shown in FIG. 4, the mass adjustment mechanism includes a plurality of weight mount points 401. In the illustrated embodiment, at least one weight mount point 401 includes a threaded socket 407 configured to receive a weight member, as described in greater detail herein.

It can be seen that center post 111 extending down from removable component 109 is fitted with a threaded insert 119. This may be, for example, an aluminum insert co-molded into crown 109. As shown, screw 127 extends through a crown fastener mount point 130 and through the sole 123, extending into the interior volume of the club head. Crown fastener mount point 130 may generally define a recessed portion on the sole 123 and may include a bore 133 shaped and/or sized to receive a portion of the screw 127 there through and into the interior volume of the club head. Screw 127 extends from shoulder 117 to threaded insert 119 to fasten removable component 109 into place. Accordingly, in the illustrated embodiment, the screw 127 extends into and through an interior volume of the club head, essentially from the sole 123 to the removable component 109 forming a portion of the crown. As previously described, screw 127 is accessible from an exterior of club head, such that a golfer has access to the screw 127 and can unfasten screw 127 and release it, thereby releasing removable component 109 for access to the interior of the club head.

Figure 5:
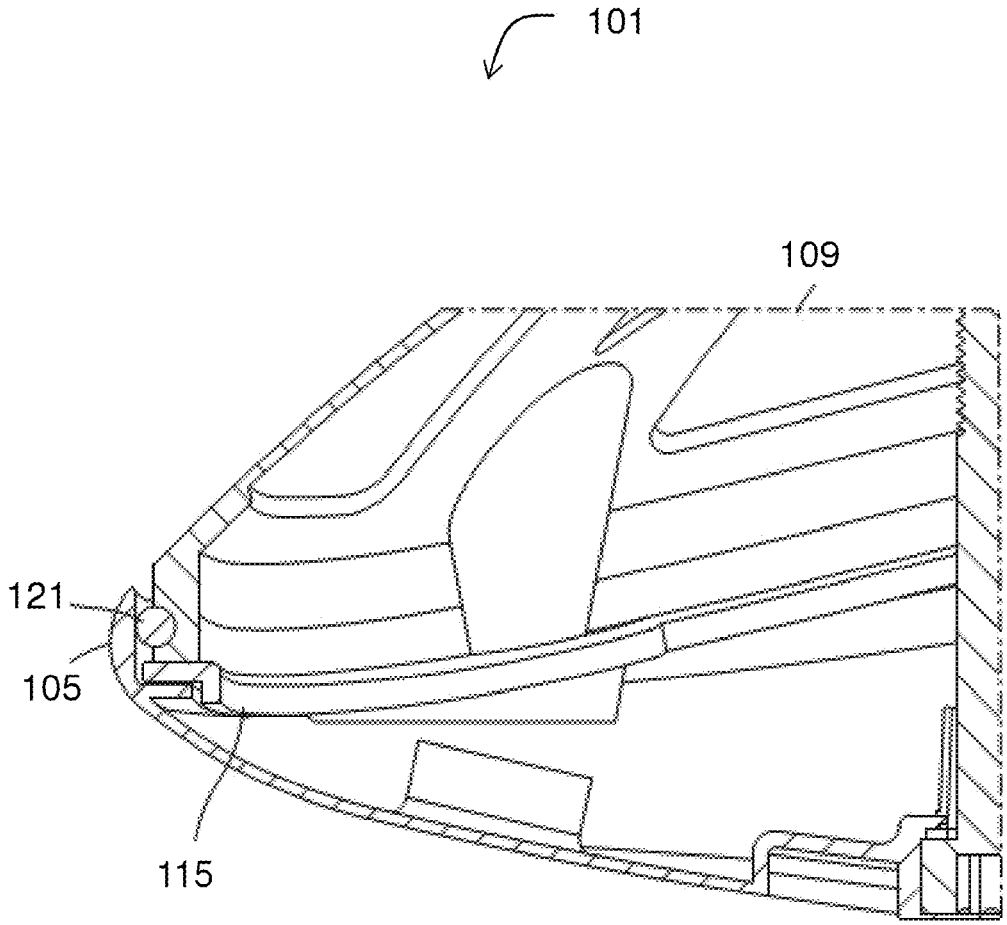
FIG. 5 illustrates the use of O-ring between a crown and club head body.

FIG. 5 illustrate the use of O-ring 121 to create a seal between removable crown 109 and club head body 105 when the crown if fastened into place. Gasket 115 helps seat crown 109 in the correct position and prevents vibration or rattle between the parts. O-ring 121 creates a moisture barrier and also can be replaced so that club head 101 provides enduring utility.

Figure 6:
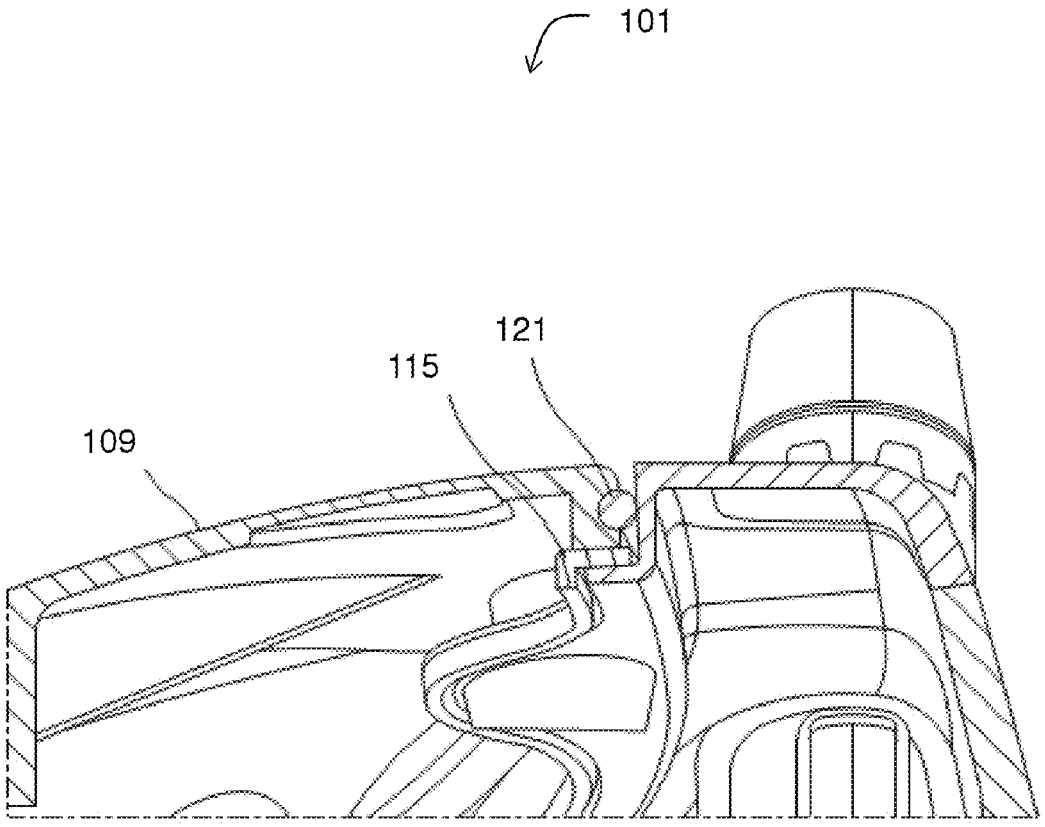
FIG. 6 shows a leading edge of connection between a crown and club head body.

FIG. 6 shows a leading edge of connection between crown 109 and club head body 105. Crown 109 seats on gasket 115 and O-ring 121 provides a seal.

Figure 7:
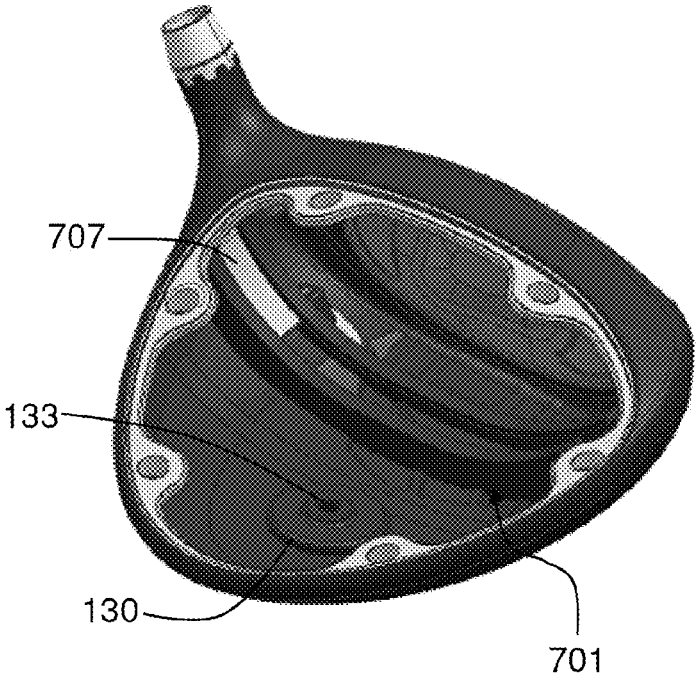
FIG. 7 shows a mounting track on an inner surface of the club head.

FIG. 7 presents an embodiment in which the mass adjustment mechanism comprises a mounting track 701 disposed on an inner surface of the club head body and a weight member 707 mounted on the mounting track. Preferably, weight member 707 is repositionable to any arbitrary position along mounting track 701. In the illustrated embodiment, mounting track 701 is disposed on the inner surface of the sole, extending substantially in a heel-toe direction. In certain embodiments, mounting track 701 defines a substantially straight line from the heel to the toe that is substantially parallel to the face. In other embodiments, the inner track system could be continuous or discontinuous on the inner perimeter edge of the club head. In other embodiments, the inner track system could extend from the face towards the aft section.

The illustrated internal track system offers benefits of making the internal weights more durable. The track has additional benefit of improving club head sound. For many golfers, auditory feedback is an important mechanism for understanding the hits that the golfer is presently making and muted or dull sounds can slow a golfer's progress in improving their skills. It may be found that weight track 701 improves the sound quality of club head 101. A significant benefit of track 701 is to provide many, even infinite, weight positions instead of a limited number of discrete positions. The advantage in the track weight design is that the design obtains the center position, as well as all the other positions in between. Club head 101 is well weighted with this design.

Figure 8:
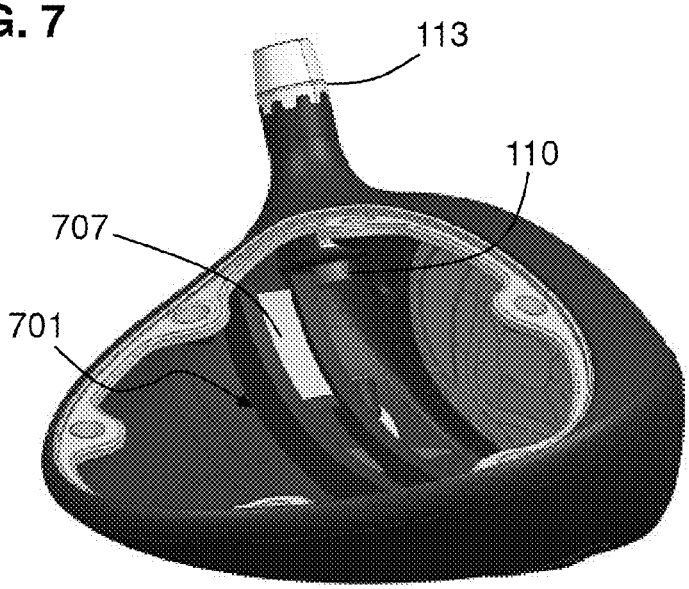
FIG. 8 illustrates a hollow, wood-type golf club head.

FIG. 8 illustrates an exemplary embodiment in which club head 101 is a hollow, wood-type golf club head and the club head body defines an enclosed interior volume, and further wherein the mass adjustment mechanism includes a mounting track 701 disposed on an inner surface of the club head body and at least one weight member 707 mounted on the mounting track 701. As shown in FIG. 8, weight member 707 can be moved along the track by removing the second body member from the club head body to access the at least one weight member.

As shown in FIG. 8, upon gaining access to the interior of the club head, a golfer may have access to a securing mechanism 110 (shown as a retention bolt) configured to secure a golf club shaft to the club head by way of the hosel 113. A golfer can manipulate the securing mechanism 110 (i.e., loosen the bolt) so as to remove the shaft in exchange for another. In some embodiments, the hosel 113 may be adjustable, such that a golfer can loosen the bolt and adjust the hosel (e.g., rotate the hosel about an axis of the shaft) so as to adjust a loft or lie angle of the club head. Embodiments of an adjustable hosel are disclosed in application Ser. No. 13/363,886, filed Feb. 1, 2012, and titled SETTING INDICATOR FOR GOLF CLUB, the contents of which are hereby incorporated by reference in their entirety. Since the securing mechanism 110 is internal and provided within the interior volume of the club head, the securing mechanism 110 is not subject to ground impact or environmental hazards during play.

Figure 9:
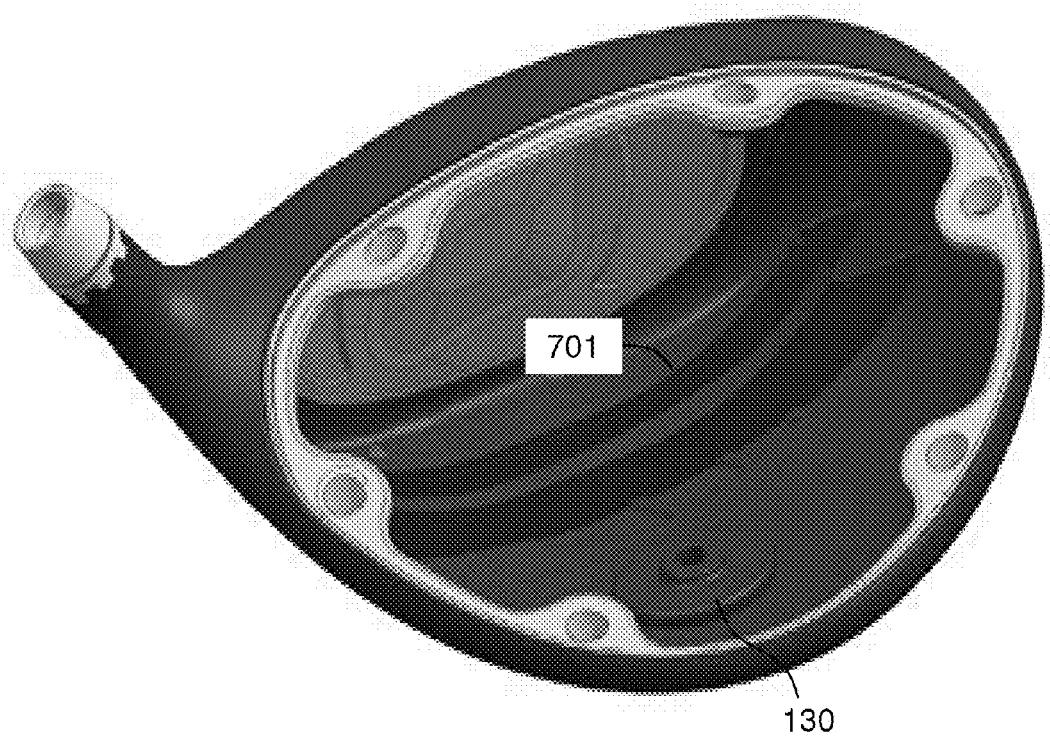
FIG. 9 shows a track and a weight mount point.

FIG. 9 illustrates an embodiment in which a club head 101 includes track 701 as well as a crown fastener mount point 130.

Other mass adjustment systems are provided by the invention for use in a golf club head.

Figure 10:
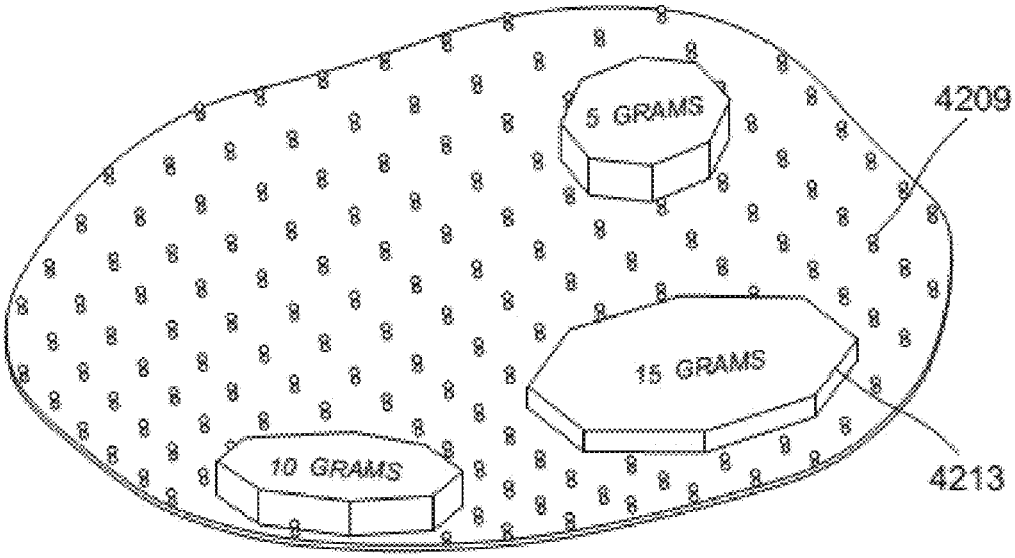
FIG. 10 shows an internal surface for a mass adjustment system.

FIG. 10 shows an internal surface for a mass adjustment system for a hollow golf club (e.g. driver). The illustrated mass adjustment mechanism includes one or more repositionable weight member 4213 having a surface configured to mount to an internal surface 4209 of the club head via a peg-and-hole press-fit system. A surface of weight member 4213 includes a plurality of holes configured to receive a corresponding plurality of pegs on the internal surface 4209 of the club head. Attachment pegs 4209 are fixed to the interior surface of the sole (or other interior or exterior surface) of the golf club head. Pegs 4209 can be provided by a metal, polymer, or other suitable material. Pegs 4209 may be formed as part of the sole material or attached after the sole shape is formed. The depicted mass adjustment system may include one or a plurality of weight members 4213 for attaching to pegs 4209.

Figure 11:
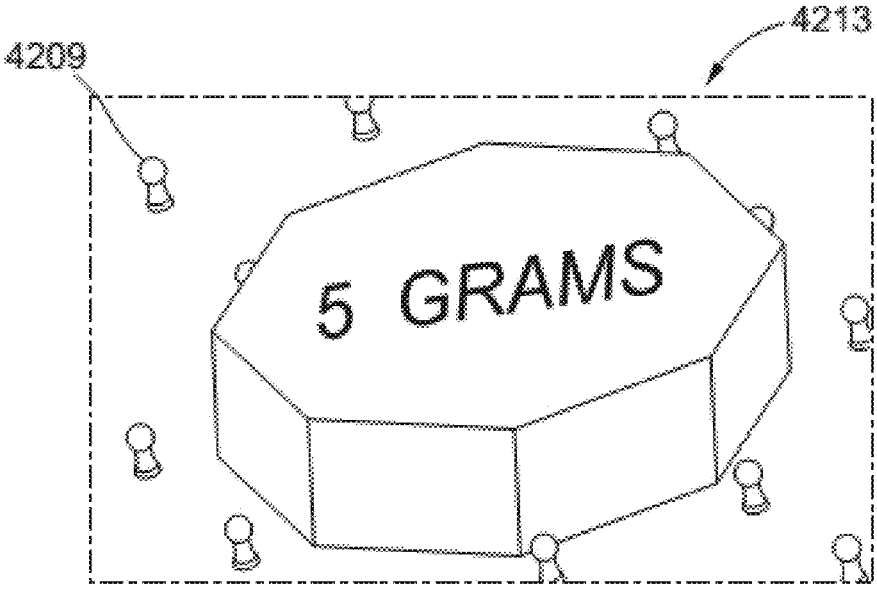
FIG. 11 gives a close-up of a weight member.

FIG. 11 gives a close-up of a weight member 4213. Weight member 4213 can include a pattern of holes on a bottom surface to correspond to a pattern of pegs 4209. In an alternative embodiment, weight member 4213 includes a material that is deformable enough that the weight member is initially whole and solid, but is pushed down over pegs 4209, causing the surface to break and receive pegs 4209 (e.g., a material like a rubbery gelatin) and may be made from silicone, rubber, a polymer, or a similar material. Weights 4213 can be made from a flexible polymer that forms to the shape of the sole surface and snaps onto the attachment pegs. Weights 4213 withstand the impact force when hitting the golf club, but can be removed by prying them off of the pegs. Weights 4213 may be various shapes, sizes, thicknesses and densities. Weights 4213 can be placed anywhere on the peg pattern to achieve desired performance attributes.

Figure 12:
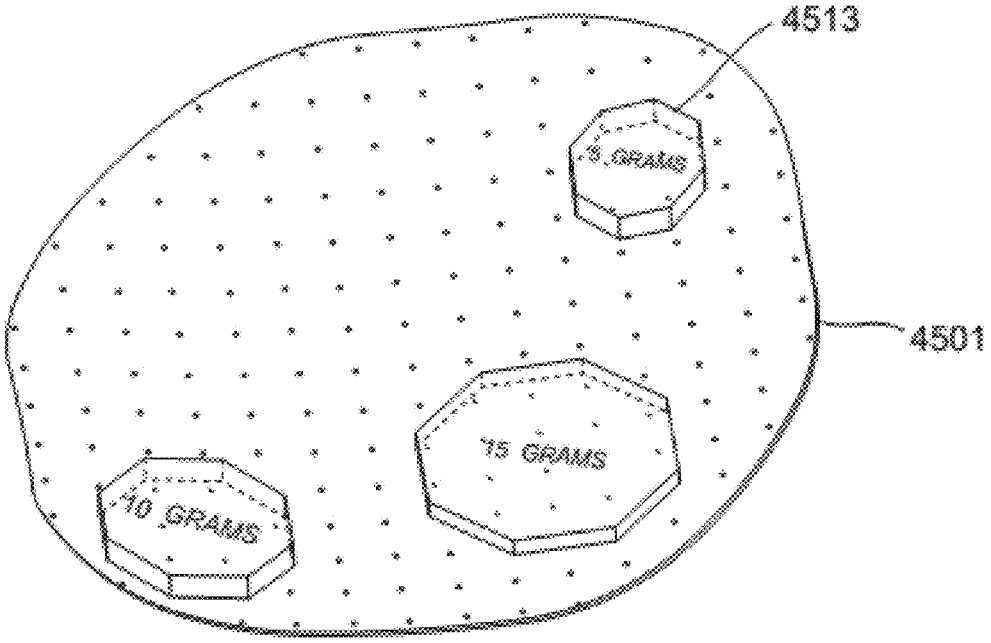
FIG. 12 shows a floor that includes holes for weight attachment.

FIG. 12 depicts a reversed embodiment in which a club head includes a false floor 4501 that includes holes for weight attachment. False floor 4501 is attached on the interior side of the sole of the golf club head. Weight member 4515 has a surface that bears a plurality of pegs configured for insertion into a corresponding plurality of holes on the internal surface of the club head.

Figure 13:
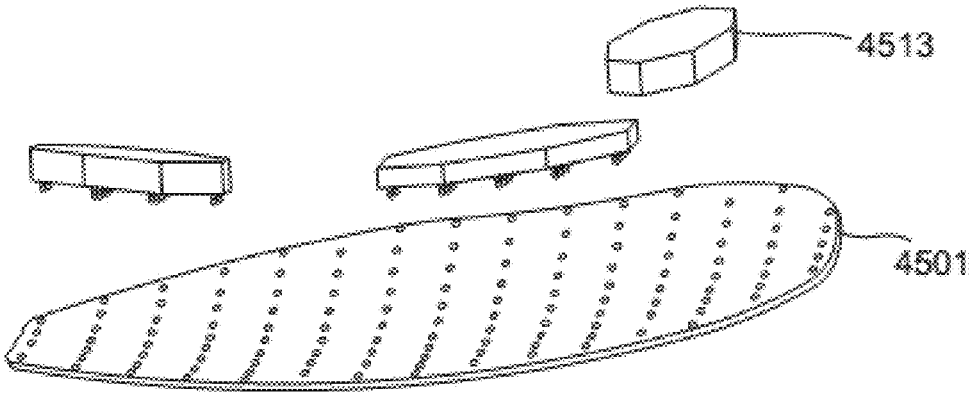
FIG. 13 shows weight members for attachment a floor.

FIG. 13 shows weight members 4513 for attachment to the holes in false floor 4501.

In some embodiments, a club head 101 of the invention includes a mass adjustment mechanism that uses one or a plurality of weight mount points.

Figure 14:
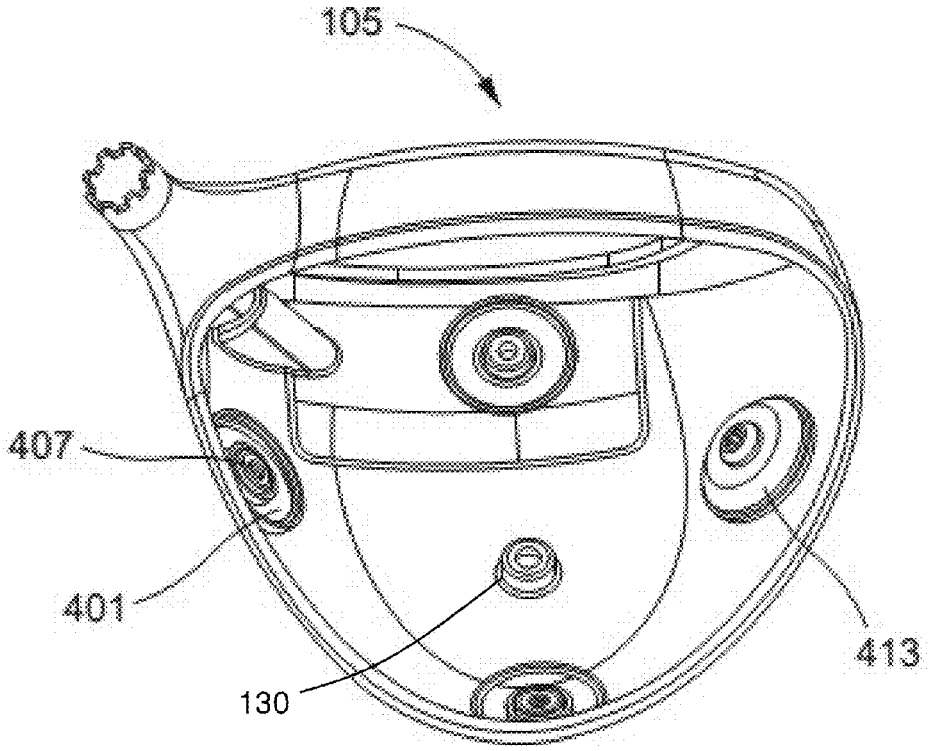
FIG. 14 shows a plurality of weight mount points.

FIG. 14 illustrates an adjustable mass system that includes a plurality of weight mount points 401. Each weight mount point 401 will typically include a mechanism 407 to which a removable weight may be affixed. Also shown in FIG. 14 is a removable or repositionable weight 413 affixed to a weight mount point 401 in a toe-side area of the inside of the sole of club head 101. Preferably, club head 101 is a hollow, wood-type golf club head (e.g., driver, fairway wood, or hybrid) and the club head body defines an enclosed interior volume, the mass adjustment mechanism includes one or a plurality of weight mount points.

Weight mount points 401 may be distributed in any suitable locations within club head 101. In general, it may be preferable to include points 401 on an interior of the sole 123 of club head 101 as golfers may find benefit in keeping a club head center of gravity low. Club head 101 may include any number of mount points 401, such as, for example, 1, 2, 3, 4, 5, 6, 10s, etc. In the depicted embodiment, club head 101 includes four mount points 401—one at each of face side, heel side, toe side, and aft side of the interior of sole 123. In some embodiments, club head 101 is made to have a certain mass such that when a certain number of removable weights 413 (e.g., one or two) are included, the overall mass of club head 101 is a desirable value.

Figure 15:
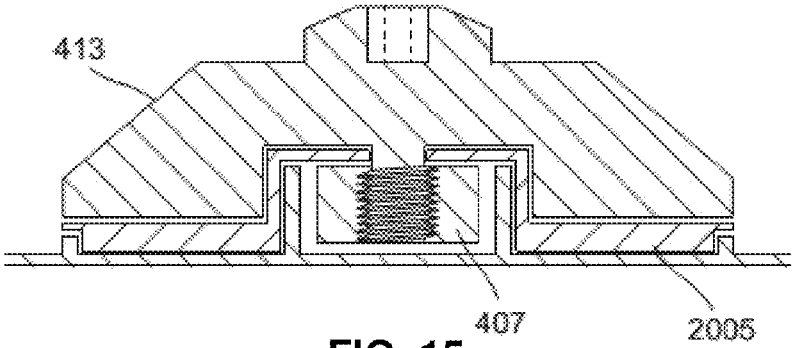
FIG. 15 shows a relationship between a repositionable weight and a weight mount port.

FIG. 15 illustrates a relationship between removable or repositionable weight 413 and weight mount port 401. Removable or repositionable weight 413 is configured for threaded attachment to one of the plurality of weight mount points 401. Weight mount point 401 includes a mounting mechanism—here, a threaded socket 407. Threaded socket 407 may be fixed into, or created within, weight mount point 401 by any suitable mechanism, such as welding, glue, press-fit, or others. In some embodiments, weight ports are cast as part of the surrounding component and threads are then tapped in. In certain embodiments, the area of the club head defines a casting (e.g., with Ti) and threads are then machined in.

Removable weight 413 includes a corresponding threaded post (and may also include a gasket, washer, or other mechanisms, to mitigate vibration and aid in good fit). Removable weight 413 can thus be fixed into, or removed from, an interior of golf club head 101 via a threaded interface. Removable weight 413 preferably includes a tool interface on an exterior surface. FIGS. 15-28 illustrate constructions of removable weights 413 according to embodiments of the invention.

FIG. 15 illustrates a two-piece construction for removable weight 413. Removable weight 413 sits in mount point 401, which may be, for example, cast in titanium (e.g., where a portion of or all of a sole 123 of club head 101 is titanium). Removable weight 413 may be made of a dense material such as tungsten alloy. Disposed between the weight and the mount point is a polymer gasket 2005. In some embodiments, polymer gasket 2005 is adhered to the bottom surface of the tungsten alloy removable weight 413. Inside of the casting for the mount point is a threaded insert 407 (e.g., adhered to the Ti casting) or threads (e.g., tapped in) to receive threaded post of removable weight 413. Polymer gasket 2005 may preferably include both horizontal walls as well as vertical walls surrounding the Ti casting of mount point 401 to aid in dissipating shear stresses associated with a ball strike.

Figure 16:
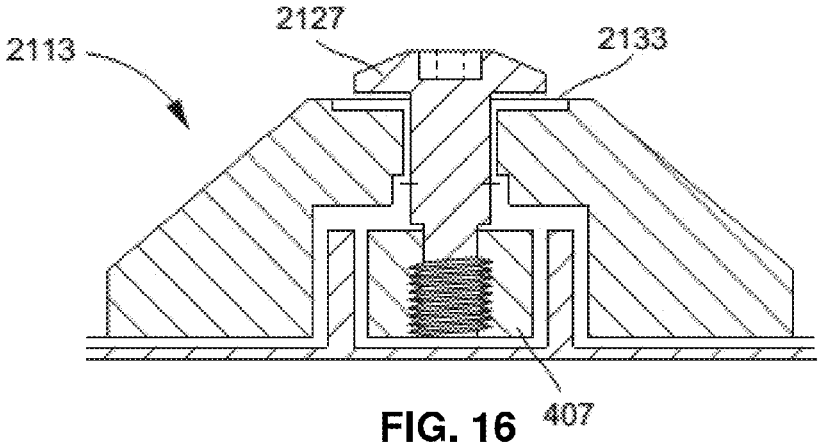
FIG. 16 shows a removable weight that includes a screw member.

FIG. 16 shows an alternative embodiment in which a removable weight 2113 includes a screw member 2127 extending through the weight body. A washer 2133 may be disposed between the head of the screw and the weight body. Optionally, a retaining ring may be included. Screw member 2127 mates with threaded insert 407.

Figure 17:
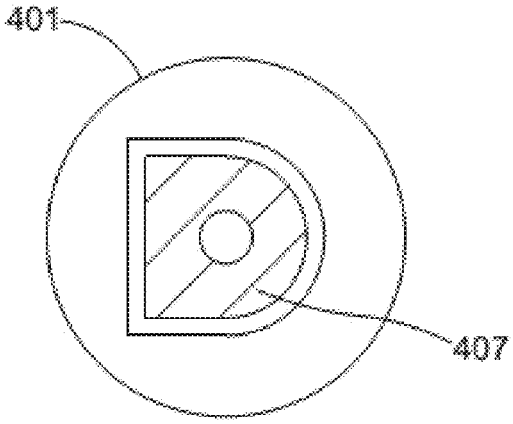
FIG. 17 shows a threaded insert and a casting of a mount point.

FIG. 17 depicts a relationship between threaded insert 407 and the casting of mount point 401. By including a flat edge, a spline, a corner, or an irregularity, threaded insert can be prevented from rotating within mount point 401. Threaded insert may have any suitable shape such as rectangle, star-shaped, hexagon, etc.

Figure 18:
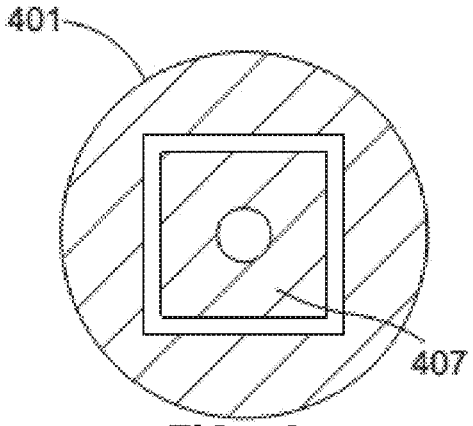
FIG. 18 shows a square cross-sectional shape to prevent rotation.

FIG. 18 illustrates an embodiment in which threaded insert 407 has a square cross-sectional shape to prevent rotation within mount point 401.

Figure 19:
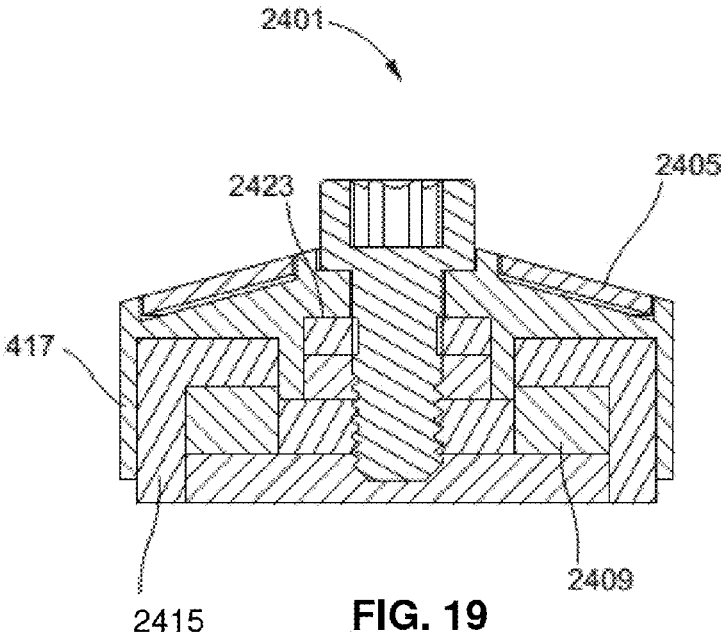
FIG. 19 shows a removable weight.

FIG. 19 shows an embodiment for a removable weight 2401. Cover 2417 defines an overall shape of removable weight 2401. Cover 2417 houses insert 2415 that provides mass. Insert 2415 can be any material of a desired density and may be, for example, tungsten-loaded rubber.

In some embodiments, insert 2415 further houses a ring member 2409 for additional weighting. Ring member 2409 may be varied to give weight 2401*a* desired mass. For example, ring member 2409 may be a steel ring selected from a set of varying thickness, or ring member 2409 may be made from any other suitable material. Cover 2417 may sport medallion 2405. By including a separate medallion 2405, different information may be added to weight 2401 after its intended mass is set (e.g., by inserting one or a plurality of ring member 2409). Thus, a plurality of cover 2417 can be manufactured uniformly and used to create a variety of different weights 2401. Different weights 2401 can include different masses through the variation of ring member 2409 and the different masses can be communicated to the user by affixing a different medallion 2405 to the cover 2417.

In certain embodiments, different weight members have different masses by having differing densities in their constituent materials. For example, a weight member body or screw may be made with metals or other materials of different densities (e.g., some tungsten screws, some aluminum screws, etc.)

Removable weight 2401 includes a screw extending therethrough for coupling to threaded insert 407. In some embodiments, removable weight 2401 will include a retaining washer 2423 (e.g., rubber) to hold the screw inside of the weight.

Figure 20:
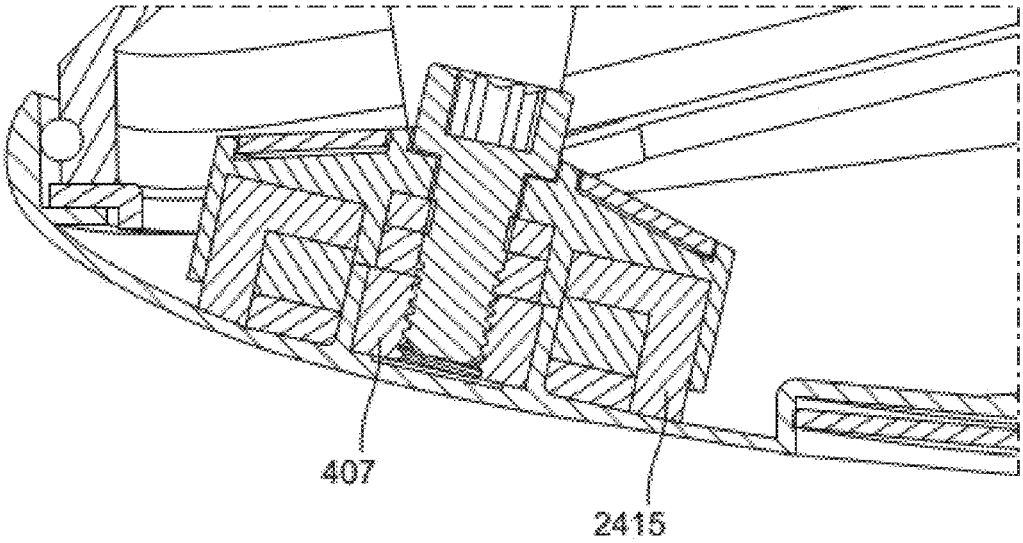
FIG. 20 shows removable weight installed in a club head.

FIG. 20 shows removable weight 2401 installed in club head 101. Weight 2401 is mounted to point 401 on an inside surface of the sole 123 of club head 101 via threaded insert 407 fixed therein (e.g., by glue). In the depicted embodiment, it will be noted that the cover 2417 defines an inner cylinder member that sits on the extended cylindrical wall of mount point 401. It may be found preferable to have weight 2401 bottom out, when being screwed into place, by having cover 2417 push against the protruding portion of mount point 401, as depicted. Since insert 2415 is preferably a pliable material such as rubber, the lowermost surface of insert 2415 deforms to conform to the curved inner surface of sole 123 thereby stabilizing removable weight 2401 inside of club head 101.

Since club head 101 can be opened and includes removable or repositionable weights, mass properties of the club head can be adjusted. In some embodiments, club head 101 can be opened by a golfer and re-closed (e.g., as many times as he or she would like). In certain embodiments, club head 101 is open initially, and is fitted to a golfer one time by adjusting the positions of the weights, and then closed and can optionally be sealed shut (e.g., by adhesive) once the club head is fitted to the golfer. Additionally, the club head may be provided with information to guide the positioning of weights. Information may be provided in the form of a color scheme, or labels on the weight mount points 401 or with an informational pamphlet, web page, computer program, or smart phone app that is made available to guide a golfer in locating weights.

A weight adjustment mechanism inside of a golf club head according to the present invention may include any suitable mechanism such as, for example, threaded, non-threaded, snap-together, adhesive based, or other assembly mechanism.

Figure 21:
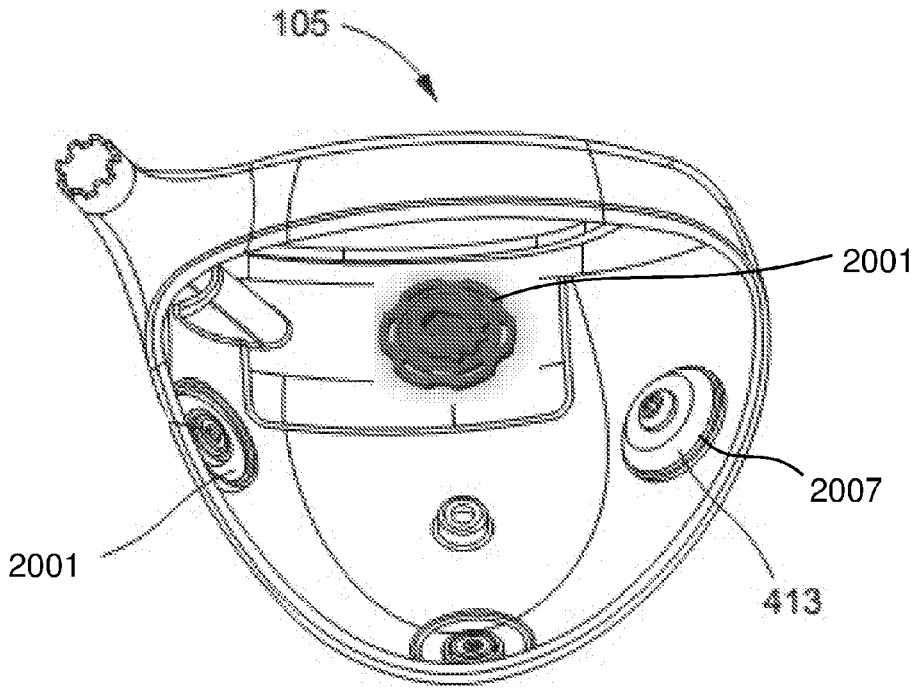
FIG. 21 shows an internal weight assembly.

FIG. 21 shows an internal weight assembly in which a weight member 2007 is configured to be inserted through a weight mount point 2001 and twisted to lockdown the weight (e.g., by hand or using a wrench). Preferably, weight mount point 2001 comprises a slot and club head 101 includes a detachable weight 2007 member having a tab configured for insertion into the slot, wherein rotating tab inside of the slot fastens the weight member to the mount point 2001.

Figure 22:
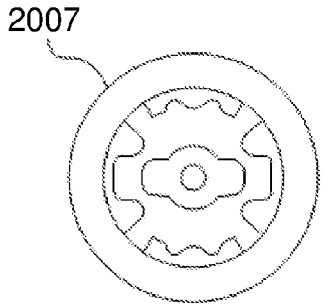
FIG. 22 illustrates the attachment side of weight member.

FIG. 22 illustrates the attachment side of weight member 2007. A central post has one or more protruding tabs that can be inserted through a slot in mount point 2001.

Figure 23:
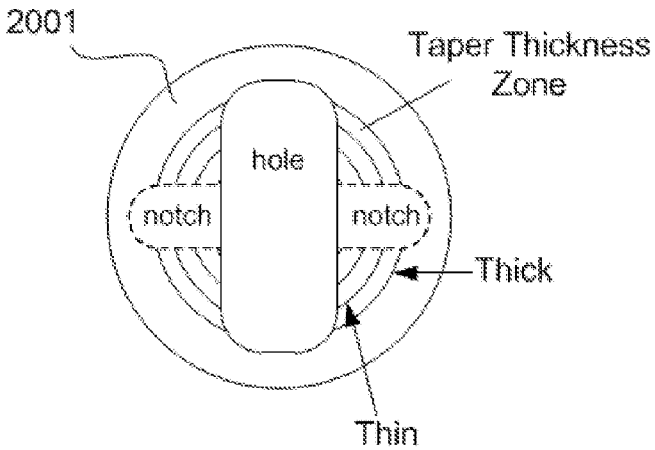
FIG. 23 shows a slot from the inside of weight mount point.

FIG. 23 shows slot 2001 from the inside of weight mount point 2001. The dotted line shows a receiving notch inside of the mount point and oblique to the slot. A user can push weight 2007 in and twist it to fix it into place.

A mass adjustment system can be additive or subtractive. Additive mass systems have been illustrated and discussed above. An additive system is based on a minimum head structure that provides acceptable durability, sound, and ball launch conditions. The additive system uses mass that may be added. Additive mass may be provided by heavy tape, glued-in weights, screwed-in weights, "snap-in" weights, or any combination of them all to establish the optimum head weight, CG position and moment of inertia. In some embodiments, the head is originally formed through casting, stamping or composite build-up with no discretionary weight onboard—i.e. it is a light weight head. The head has basic functionality with good sound, acceptable durability, and acceptable golf ball launch conditions. Weight pad areas may be designated inside the head, for example, with markings for the placement of discretionary mass. Weights are located in specific combinations on the pad areas to obtain the desired head weight, center of gravity location, and moment of inertia. Weights can be heavy tape (commonly known as "lead tape"), snap-on, heavy metal infused thermoplastic, heavy metal infused rubber, heavy metal infused glue (i.e. "rat glue"), glued-on mass, screws, or others.

A subtractive system generally involves a club head that is manufactured to have a mass greater than a desired mass, such that the club can be customized by selectively removing mass. For example, a subtractive system may include specifically located weight pads that are molded (e.g., cast) into the head that can be machined away to establish the optimum head weight, CG position, or moment of inertia.

Figure 24:
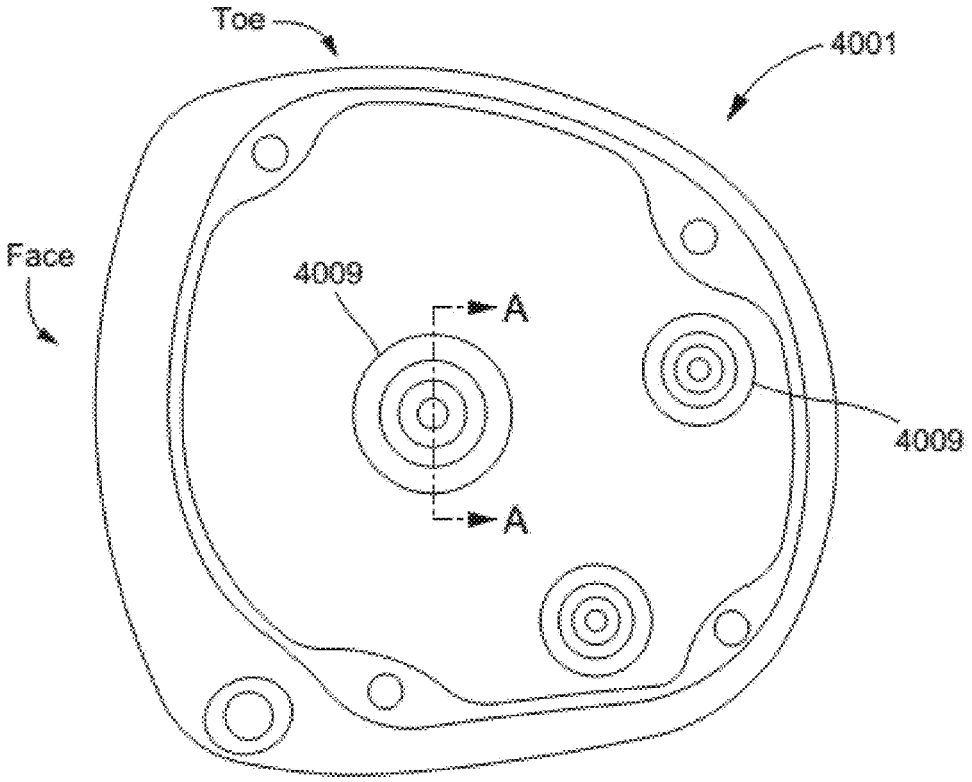
FIG. 24 shows a club head with a subtractive mass adjustment system.

FIG. 24 shows a club head 4001 with a subtractive system. Club head 4001 includes a plurality of mass pads 4009. Pad can be taken to mean a defined or raised area (e.g., in the sense that a concrete "pad" is poured when building a shed). Weight pads 4009 are preferably areas of the overall body shell of club head 4001 that are thicker than the surrounding areas. Weight pads 4009 are incorporated into the head (cast, stamped, welded) and the baseline head has excessive discretionary mass—i.e. it is heavy. The head has basic functionality, good sound, acceptable durability and acceptable golf ball launch conditions.

Figure 25:
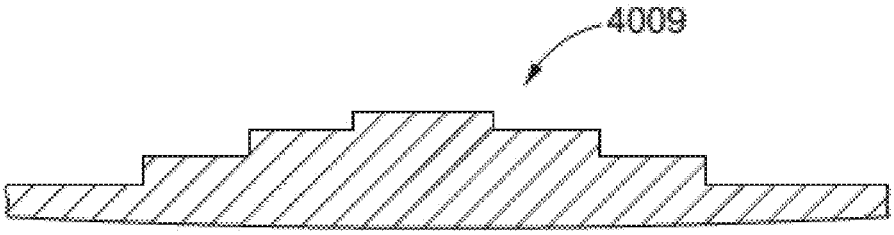
FIG. 25 gives a cross-section through a weight pad in a subtractive system.

FIG. 25 gives a cross-section through a weight pad 4009 as manufactured initially in a club head 4001 with a subtractive system. The weight pads may be machined away in a specific pattern to obtain desired head weight, center of gravity location and moment of inertia. For example, a consultant at a pro-shop can use a rotary tool, such as the rotary tool sold under the trademark DREMEL with a grinding attachment, and can remove weight pads 4009 to bias the club head according to a golfer's swing style.

In other embodiments of the invention, the mass adjustment mechanism inside of club head 101 operates via one or more mount points that define pockets configured to receive a weight member.

Figure 26:
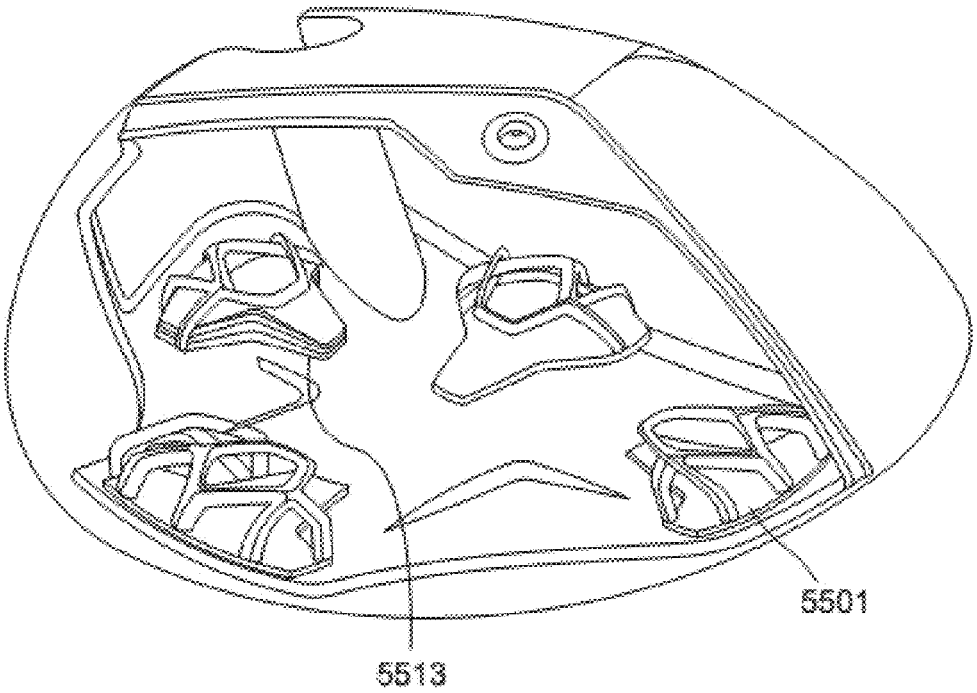
FIG. 26 shows mount points retaining weight members.

FIG. 26 shows mount points 5501 retaining weight members 5513. Here, weight members 5513 are non-round and thus unable to rotate in place once retained in cage-like, or pocket-like, mounting points 5501.

Figure 27:
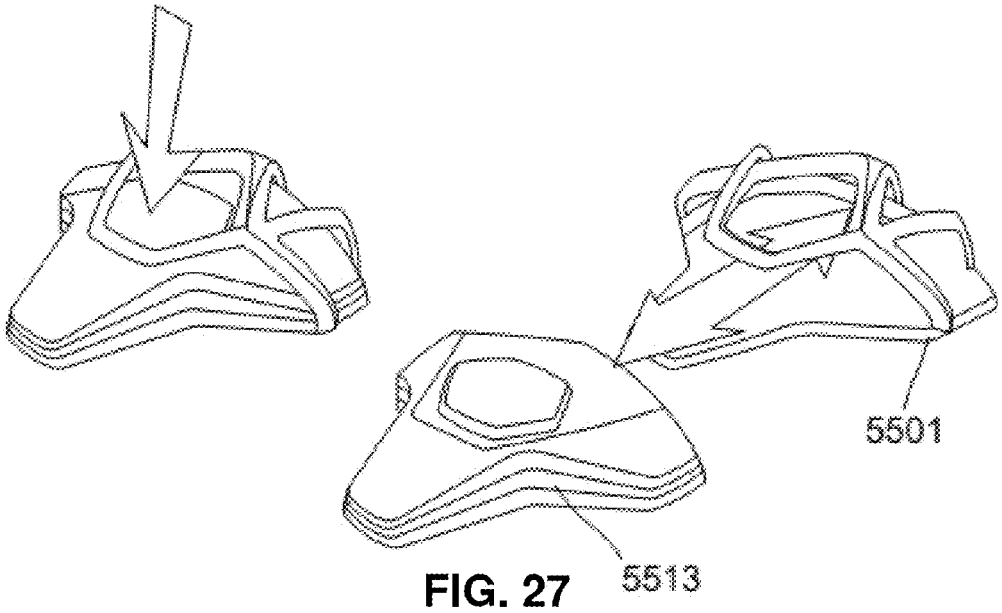
FIG. 27 shows a mount point and a weight member.

FIG. 27 shows a mount point 5501 and a weight member 5513 as shown inside of a club head in FIG. 26. It can be seen that weight members 5513 may include a button that can be pressed to release them from mount points 5501 and that weight members may be inserted by sliding them into mount points 5501. It may be found preferable to use non-round weight members so that they do not rotate during use of the club head. The cage shape of mount points 5501 may be preferred for fastening the weight members therein.

Figure 28:
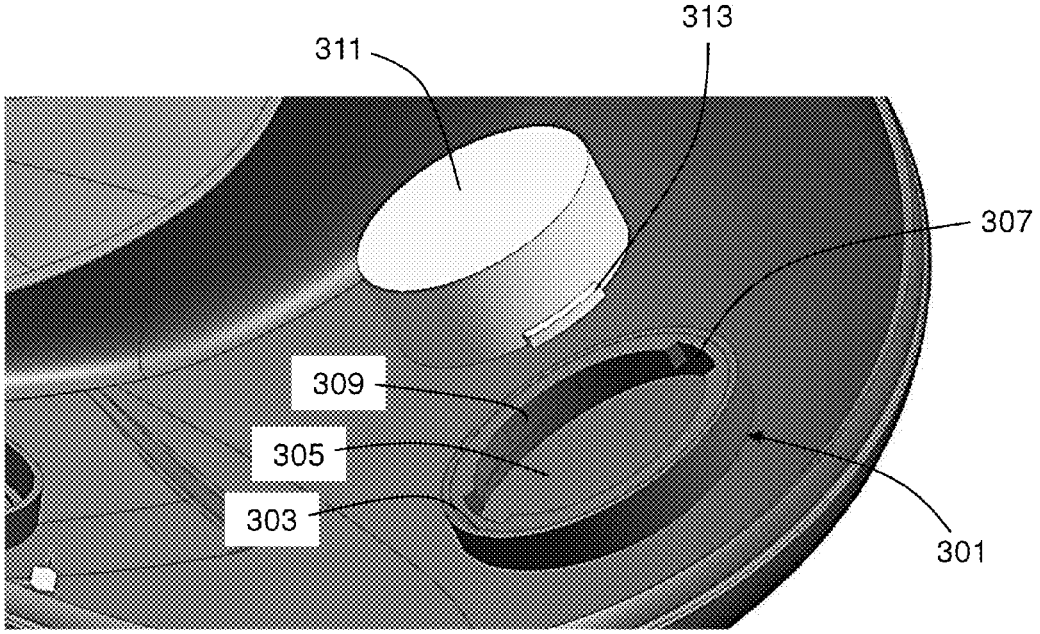
FIG. 28 shows another embodiment of an internal weight assembly.

FIG. 28 shows a mount point 301 for receiving a weight member 311 as shown inside of a club head. In this embodiment, the mount point 301 includes a raised wall 303 defining a generally annular shape and forming a cavity 305 within shaped and/or sized to receive at least a portion of the weight member 311 within. The weight member 311 is secured to and retained within the mount point 301 by way of a track 309 formed within an inner surface of the wall 303 and extending along a perimeter thereof. For example, the weight member 311 may include one or more flanges 313 to be received within one or more associated slots 307 formed within the wall 303. The slots 307 are communicatively coupled to the track 309, such that, upon insertion of the flanges 313 into the respective slots 307, a golfer need only rotate the weight member 311 (e.g., a quarter turn) so as to slide the flanges 313 from the slots 307 into the track 309 until the flanges 313 are no longer in alignment with the slots 307. The track 309 is shaped and/or sized to retain the flanges 313 within, thereby securing the weight member 311 to the mount point 301. The track 309 may further include pockets or recessed portions 314 shaped and/or sized to receive associated flanges 313 so as to establish a secure coupling of the weight member 311 to the mount point 301.

Figure 29:
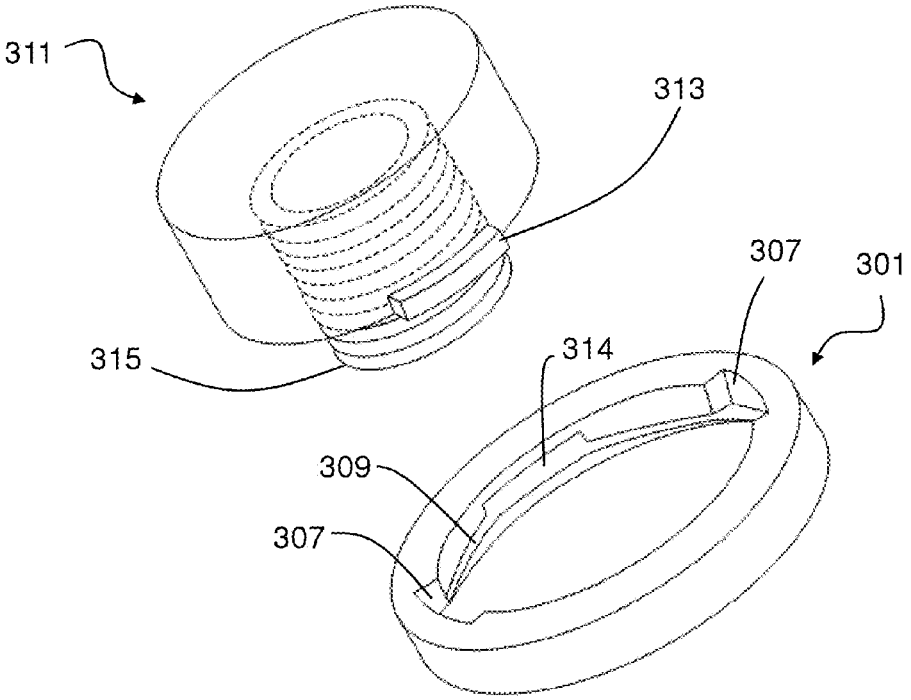
FIG. 29 shows a removable weight that includes a spring member.

For example, FIG. 29 shows a removable weight member 311 that includes a spring member 315 and a more detailed view of the mount point 301. The spring member 315 is configured to apply a biasing force upon insertion of the weight member 311 into the mount point 301, thereby further enhancing the coupling of the weight member 311 to the mount point 301. For example, upon alignment and insertion of the flanges 313 of the weight member 311 into the respective slots 307, the spring member 315 applies a biasing force against the weight member 311 and the mount point 301 that is partially overcome upon a golfer pushing the weight member 311 towards the mount point 301. Upon rotation of the weight member 311 so as to slide the flanges 313 into engagement with the track 309 and further into alignment with the recessed portions 314, the spring member 315 continues to apply a biasing force resulting in securement of the flanges 313 within the recessed portions 314. In the event that a golfer wishes to remove the weight member 311, they need only disengage the coupling of the flanges 313 from the associated recessed portions 314 of the track 309 (by pushing the weight member 311 towards the mount point 301 to partially overcome the biasing force of the spring member 315) and then rotate the weight member 311 until the flanges 311 are in alignment with associated slots 307, at which point, the weight member 311 may pop out due to the biasing force from the spring member 315.

Figure 30:
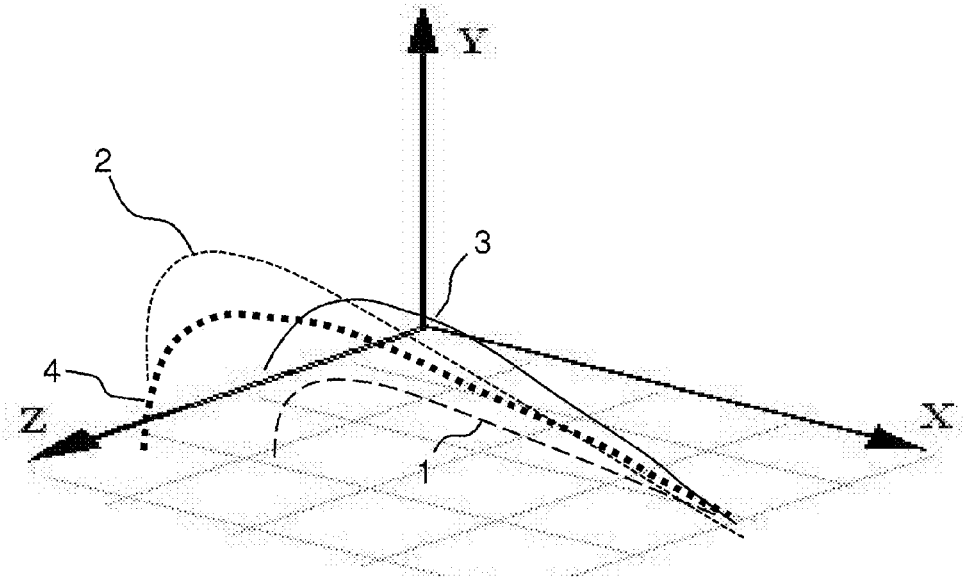
FIG. 30 illustrates types of adjustments that may be made using systems of the invention.

FIG. 30 illustrates types of adjustments that may be made using systems of the invention. FIG. 28 additionally illustrates material that may be provided to a golfer to aid in using a system of the invention (e.g., printed or digital). The graph depicts flight trajectories that may be favored by different adjustments to mass distributions. A mass adjustment system may be labeled to correspond to positions on the depicted graph, thus informing a golfer of how to adjust the mass via the mass adjustment system to obtain a desired correction in ball flight trajectory.

Figure 31:
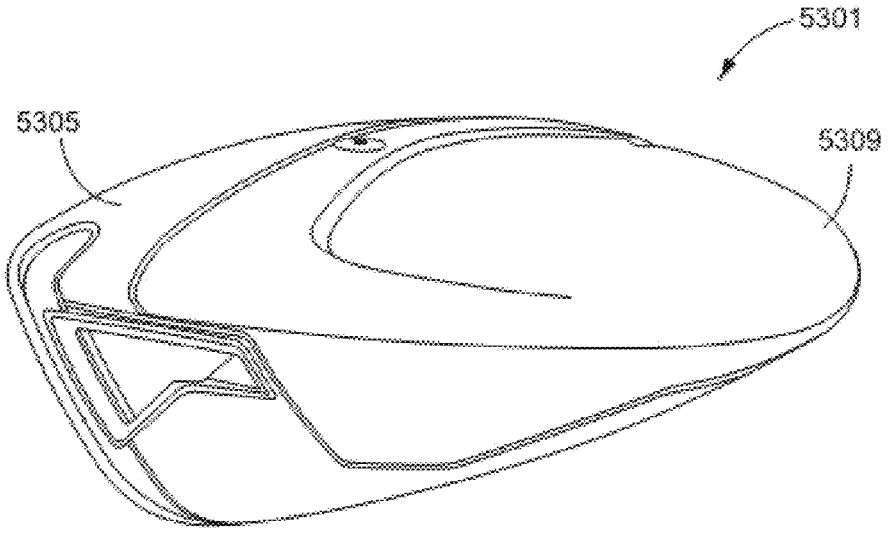
FIG. 31 depicts a golf club head in which an interior of the club head is accessible.

FIG. 31 depicts a golf club head 5301 that includes a club head body 5305 comprising a sole, a crown, a face, and a hosel, and in which an interior of the club head is accessible for adjustment. Club head 5301 is a hollow, wood-type club head that is accessible by means of an opening mechanism. As shown in FIG. 31, the opening mechanism, when open, provides an aperture giving access into an interior volume of the club head body that is enclosed with the opening mechanism is closed, wherein the aperture has an open area of at least 3 $cm^2$.

Figure 32:
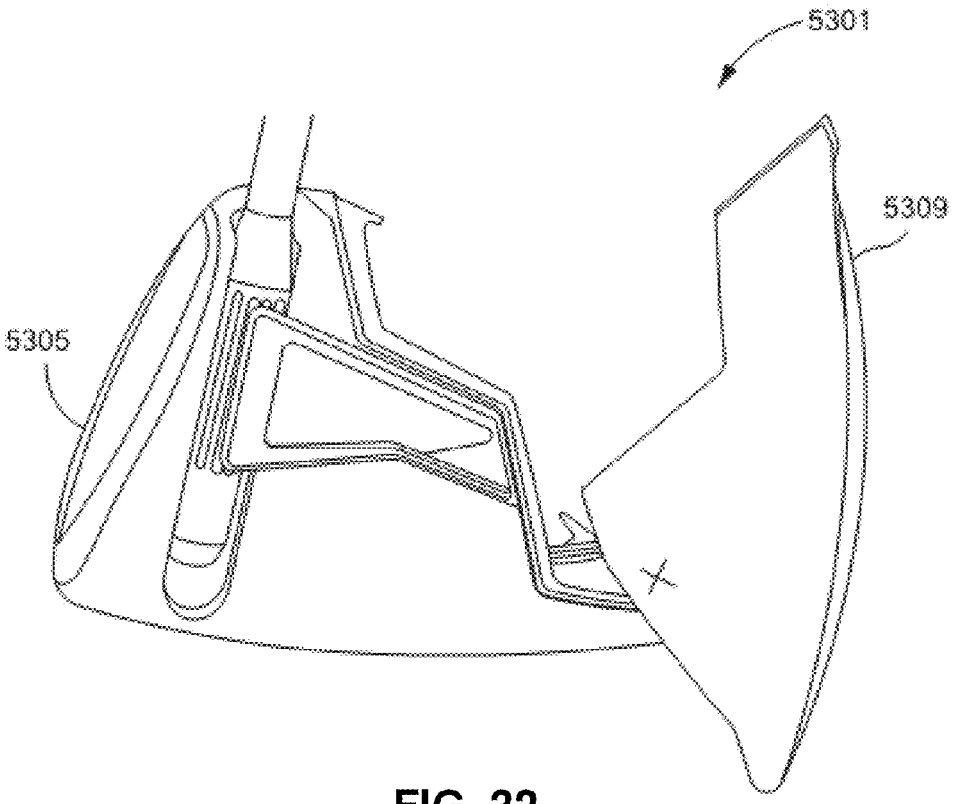
FIG. 32 shows a club head in an open state.

FIG. 32 shows club head 5301 in an open state, showing that the opening mechanism has an openable portion 5309 that is configured to be opened without being removed from club head body 5305. Openable portion 5309 is attached to the club head body via a hinge. Club head 5301 may include an adjustment mechanism within club head body 5305 for adjusting a property of the club head.

Figure 33A:
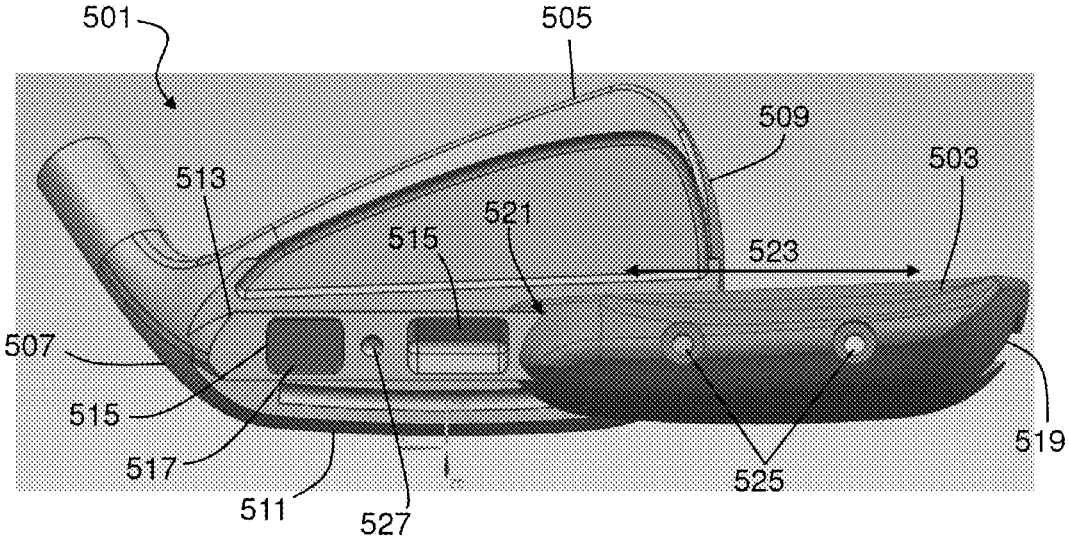
FIGS. 33A-33C show an iron-type club head with an accessible interior.
Figure 33B:
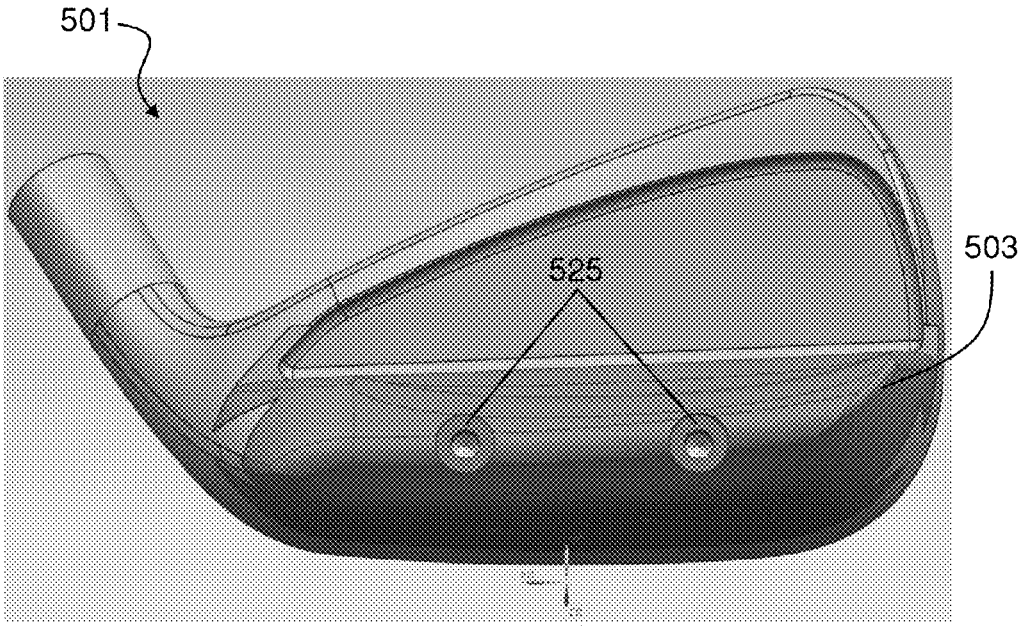
Figure 33C:
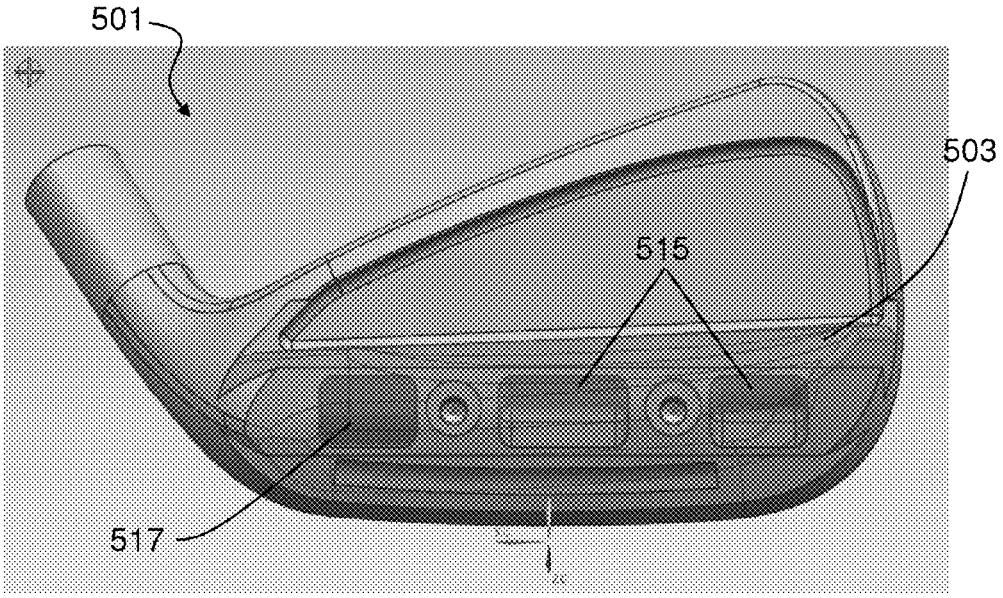

FIGS. 33A-33C show an iron-type club head 501 with an accessible interior. As shown, the club head 501 includes a removable component 503 (e.g., a slidable cover) that can provide functionality in a number of ways. For example, the slidable cover 503 may be used to enclose an interior portion of the club head body 505. The club head body 505 generally includes a heel 507, toe 509, and sole 511. The club head body 505 further includes a track 513 formed on a portion thereof. As shown, the track 513 is generally formed on a back portion of the body 505 adjacent to the sole 511 and extending in a direction from the heel 507 to the toe 509, substantially parallel to the sole 511. In other embodiments, the track 513 may be arranged in other positions and directions (e.g., vertically). The body 505 further includes one or more mount points 515 for coupling weight members 517 thereto. For example, as shown, the mount points 515 are in the form of recesses shaped and/or sized to receive associated weight members 517 therein. It should be noted, however, that the mount points 515 and weight members 517 may be in the form of any one of the embodiments previously described herein.

As shown, the track 513 is configured to receive a corresponding portion of the cover 503 so as to allow the cover 503 to be slidably mounted thereon. For example, the cover 503 generally includes a slot or channel 519 shaped and/or sized to receive the raised track 513, as indicated by arrow 521. It should be noted that in other embodiments, the track 513 may be in the form of a channel and the cover 503 may include a protrusion 519 to be received within the track 513. The cover 503 is thus slidably mounted to the club head 501 by way of the track 513 and channel 519 interface. The cover 503 is configured to slide along the track either towards the heel 507 or towards the toe 509, as indicated by arrow 523, thereby allowing a golfer to completely enclose and secure weight members 517 within the mount points 515, and, when desired, remove the cover 503 to gain access to the weight member 517. The particular placement of the weight members 517 according any arrangement may have a particular effect on performance characteristics of the golf club head 501. For example, a golfer can place the weight members 517 in a desired arrangement that alters center of gravity, moment of inertia, and/or swing weight of the club head 501.

The cover 503 further includes one or more mounting portions 525 (e.g., bores) through which fasteners can be inserted and secured to corresponding mounting portions 527 formed on the club head body 503. For example, as shown in FIGS. 33B and 33C, when the cover 503 is in a closed position (e.g., cover 503 enclosing weight members 517 and mount points 515), a fastener (e.g., screw, bolt, or any other suitable fastener such as a barbed post, a cotter pin, or other binder) may further secure the cover 503 to the club head 501 in a closed position. Accordingly, when the fastener is in place, the cover 503 is held in place and the club head 501 can be used in playing golf. A golfer can use a tool, such as a specialty tool with a custom tip, to unfasten the fastener, and the golfer can release the cover 503 and slide to an open position to gain access to the mount points 515 and/or weight members 517 (e.g., add, remove, or exchange weights, alter configuration and placement of weights, etc.).

Figure 34A:
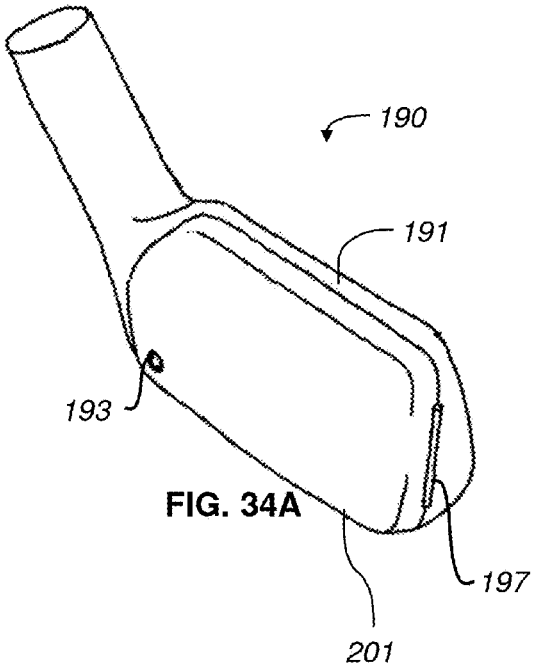
FIGS. 34A-34D show an iron-type club head with an openable member.
Figure 34B:
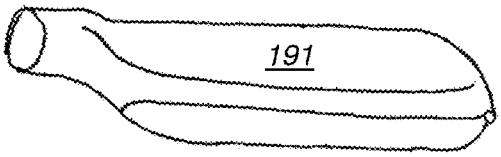
Figure 34C:
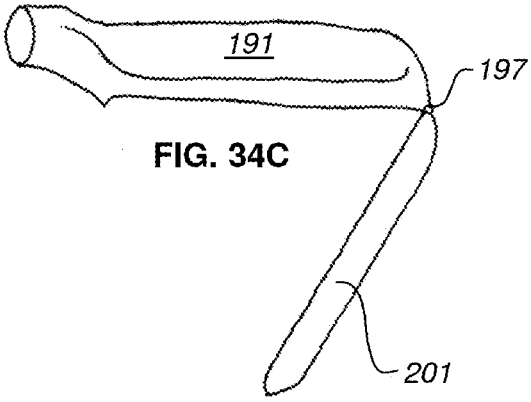
Figure 34D:
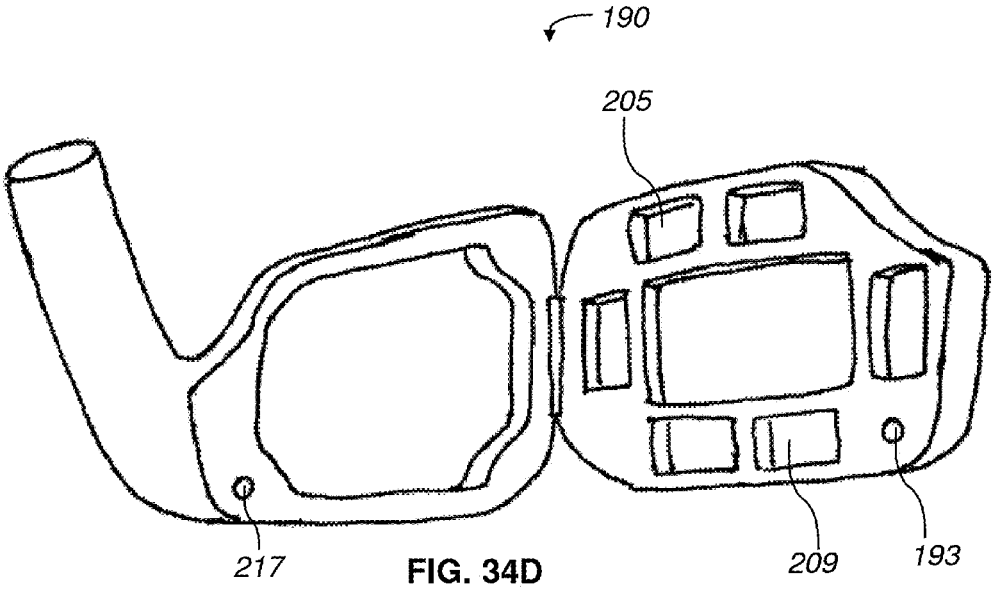

FIGS. 34A-34D show a club head 190 with an openable door 201 (e.g., a hinged cap) that can provide functionality in a number of ways. In some embodiments, FIGS. 34A-34D show a club head 190 with an openable door 201 that provides a mechanism for adjusting a club head center of gravity in a vertical direction. Member 201 is mounted on club head 190 via hinge 197. Member 201 optionally includes fastening mechanism 193 to maintain club head 190 in a closed configuration (as shown in FIGS. 34A and 34B). FIGS. 34C and 34D show club head 190 in an open configuration. Body member 191 can optionally include a component 217 of fastening mechanism 193. In some embodiments, fastening mechanism 193 includes a set screw (e.g., on openable door 201) and a threaded receiving hole (e.g., on body member 191). In some embodiments, fastening mechanism 193 includes a magnet such as, for example, a high powered magnet (e.g., a rare-earth element magnet).

Club head 390 includes a center of gravity that is adjustable in a vertical direction. In some embodiments, high port 205 and low port 209 are provided as recesses in door 201 (e.g., on an inside surface so that they are not visible when club head 190 is in a closed configuration). One or more weight members may be provided that mount in any of the ports. A weight member may be retained in a port by any suitable method. Suitable methods for retaining a weight member in a port include: dimensioning the weight and club head so that a back of the body member 191 holds the weight in place when club head 190 is in a closed configuration; adhesives; magnets (e.g., high powered magnets such as rare earth elements); a press-fit construction; a snap fit construction; one or more of a screw or similar fastener; spot-welding; or other similar methods.

By repositioning weight members among the ports depicted in FIG. 34D, a golfer may adjust a center of gravity in a vertical direction. In some embodiments, a door 201 further includes ports in a center, near a heel end, near a toe end, or anywhere else within.

Figure 35:
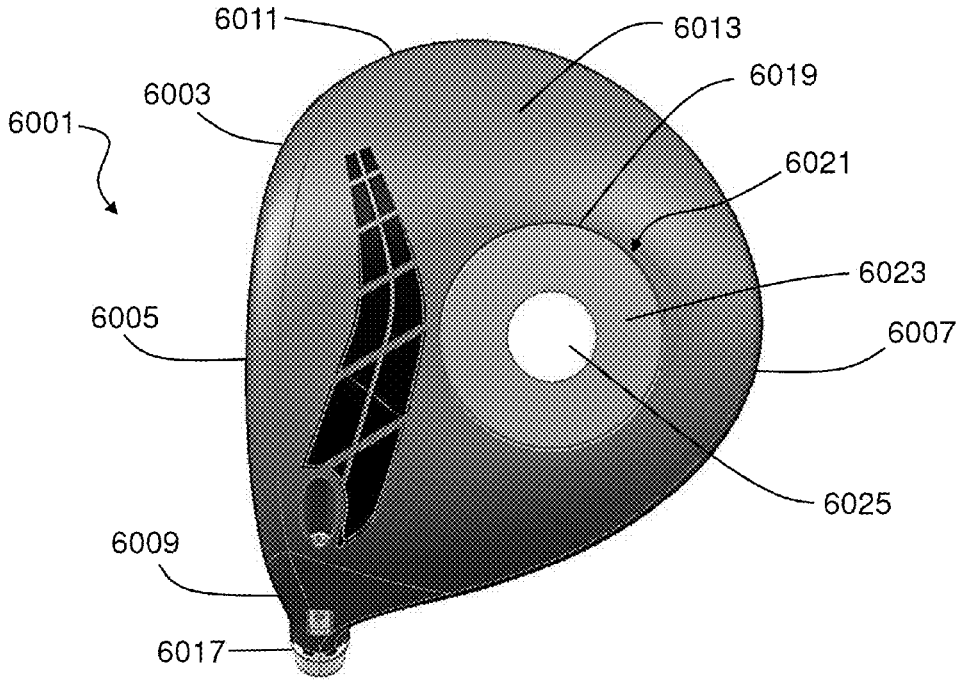
FIG. 35 shows a bottom view of golf club head including a port for providing a view to an interior of the club head.
Figure 36:
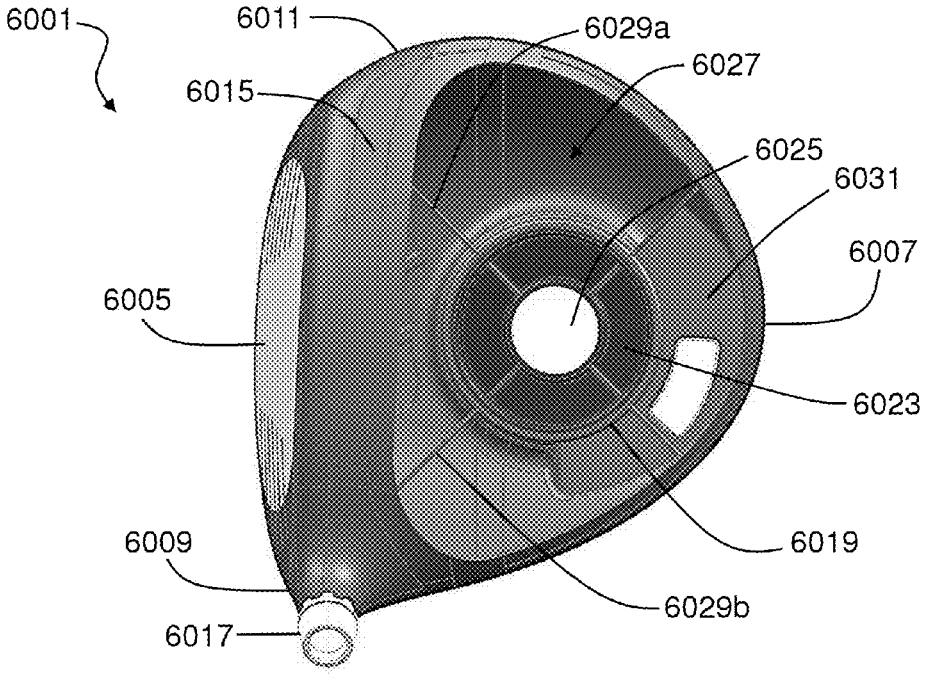
FIGS. 36-38 show top perspective views of the club head of FIG. 35 with a portion of the crown removed illustrating the interior of the club head.

FIG. 35 is a bottom view of a golf club head 6001 including a port 6021 for providing a view, and in some embodiments, access to an interior of the club head. FIG. 36 is a perspective view, partly in section, of the golf club head of FIG. 35. As shown, the golf club head 6001 may include similar elements as club head previously described herein and all of the advantages associated therewith. For example, the club head 6001 includes a body 6003 having a ball-striking face 6005, a rear portion 6007, a heel 6009, a toe 6011, a sole 6013, a crown 6015, and a hosel 6017. A portion of the crown 6015 is shown removed in FIG. 36 to illustrate interior 6027 of club head. The club head 6001 further includes a mounting portion 6019 formed on the sole 6013 and a port 6021 coupled to the mounting portion 6019.

The port 6021 includes a body portion 6023 and a viewing portion (hereinafter referred to as window) 6025. The window 6025 includes a transparent or translucent material capable of allowing a user to view the interior cavity 6027 of the club head 6001 when the port 6021 is coupled to the sole 6013. Accordingly, when the port 6021 is coupled to the mounting portion 6019, a user can view the interior cavity 6027 by way of the window 6025. The window 6025 and or body 6023 of the port 6021 may be composed of a durable and/or scratch-resistant material, so as to withstand impact forces accompanied with use of the club head 6001, particularly if placed on the sole 6013 of the club head 6001.

The window 6025 may further include one or more portions configured to provide an optical effect. For example, in one embodiment, at least a portion of the window may provide a magnified view into the interior cavity 6027 of the club head 6001. Accordingly, a portion of the window 6025 may include a convex lens portion. Providing a magnified view is particularly beneficial as the interior cavity 6027 may provide very little clearance for the inclusion of components, markings, indicia, decals, etc. Accordingly, in some embodiments, the components, markings, indicia, decals, etc., may be relatively small and difficult for a golfer to clearly see. Thus, a magnifying portion of the window 6025 will provide a golfer with a magnified view into the interior cavity 6027, thereby providing the golfer an opportunity to fully appreciate the components and/or informative markings, indicia, decals, etc., therein, without having to gain access to the club interior. The lens portion of the window 6025 may provide a range of optical magnification (referred to as power). In one embodiment, the window 6025 may have between 1× and 100× power. In another embodiment, the window 6025 may have between 2× and 10× power.

Additionally, or alternatively, the window 6025 may provide other optical effects. For example, one or more portions of the window 6025 may have a shape/contour and/or be composed from a material having an optical spectral effect, such as a guiding effect so as to direct the light towards a desired direction. For example, in one embodiment, one or more portions of the window 6025 may be configured to carry light from the exterior of the club head into the interior of the club head. In another embodiment, one or more portions of the window 6025 may be configured to carry light from within the interior of the club head towards the exterior of the club head (e.g., collect light from within the club head and out through the window 6025). Accordingly, in some embodiments, the window 6025 material may additionally, or alternatively, having a scattering effect on light.

For example, in one embodiment, a source of illumination, such as a light emitting diode (LED) may be included within the interior cavity 6027 of the club head. The window 6025 may be configured to allow light emitted from the LED to pass therethrough and out to the exterior of the club head 6001. In some embodiments, one or more portions of an interior surface of the club head may include luminescent paint. Accordingly, in addition to providing a more visible interior cavity, the LED and/or luminescent paint may provide interesting lighting effects, which may be desirable.

It should be noted that, although depicted as being positioned on the sole 6013, the port 6021 may be positioned on any portion of the club head 6001 (e.g., crown, toe, heel, skirt, ball-striking face, etc.). Designing a removable port in a golf clubs head presents a unique challenge: crowns are generally thin and often fail to provide adequate support for removable structures; faces present a challenge for removable features due to stringent USGA restrictions on face geometry and features; and skirts present too small an area for internal club access to be useful. Accordingly, the sole of the club head is generally regarded as the most feasible location for a removable port, as the sole is often thicker than other areas of the club head, where extra weight is often desired.

The port 6021 may be included on any one of the embodiments of club heads consistent with the present disclosure. As such, the port 6021 may be particularly advantageous when included on a club head with an accessible interior. For example, in club head having an internal weight system, as described herein, a golfer may wish to know the current setting so as to best determine how to approach any given shot. Rather than having to gain physical access to the interior of the club head (e.g., manipulate opening mechanism to gain access) in order to see the current weight setting/placement, the port 6021 provides the golfer with a view to the interior cavity 6027 of the club head and any components (e.g., weights, weight systems, etc.) markings, indicia, etc., within, thus saving the golfer time and effort. In some embodiments, the port 6021 may be permanently fixed to the mounting portion 6019 of the club head 6001. In other embodiments, the port 6021 may be removable, thereby providing access to the interior of the club head, in addition to provide a view.

The club head 6001 further includes one or more main stiffening elements (hereinafter referred to as main ribs) 6029*a*, 6029*b* extending along an interior surface of the sole 6013 between the mounting portion 6019 and the face 6005 of the club head 6001. As described in greater detail herein, the main ribs 6029*a*, 6029*b*, in conjunction with the port 6021, provide sound tuning characteristics, resulting in increasing the frequency of the port, thereby improving acoustic properties of the club head 6001. The main ribs 6029*a*, 6029*b* may further provide structural stiffness and vibration damping, resulting in advantages as understood by one skilled in the art.

The club head 6001 may further include a weight pad 6031 formed along a portion of the interior surface of the sole 6013. In the illustrated embodiment, the weight pad 6031 is between the port 6021 and the rear portion 6007 of the club head. As generally understood, the weight pad 6031 may provide an additional means for adjusting mass properties of the club head 6001 by way of placement of weight at a desired position so as to affect performance characteristics (e.g., center of gravity, moment of inertia, swing weight, etc.) of the club head 6001. The weight pad 6031 may include a discretionary mass, for example, constructed of materials that are different than the remainder of the materials of the body 6003 of the club head 6001. The weight pad 6031 may be dedicated to alter the mass characteristics of the golf club head 6001, such as by using it to lower the location of the center of gravity or to increase the moment of inertia.

Figure 37:
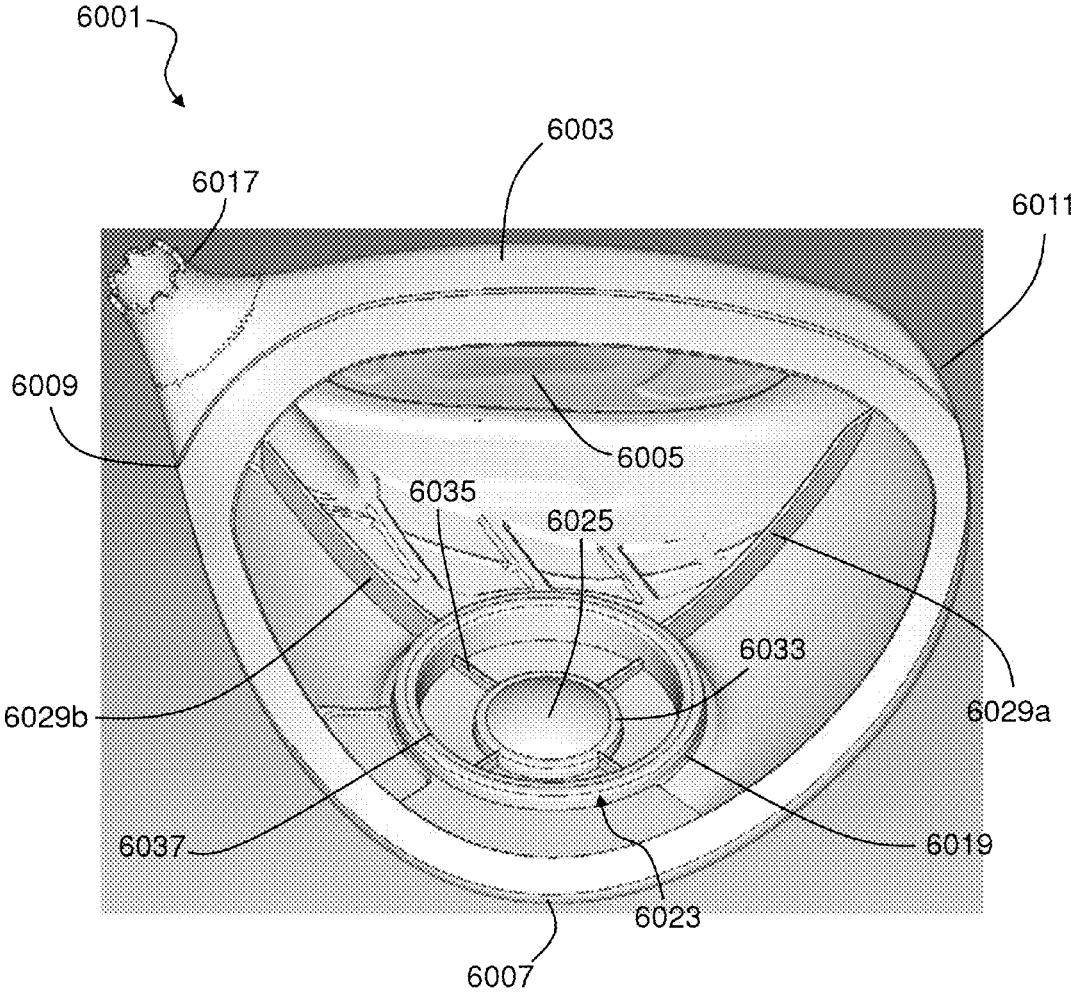
Figure 38:
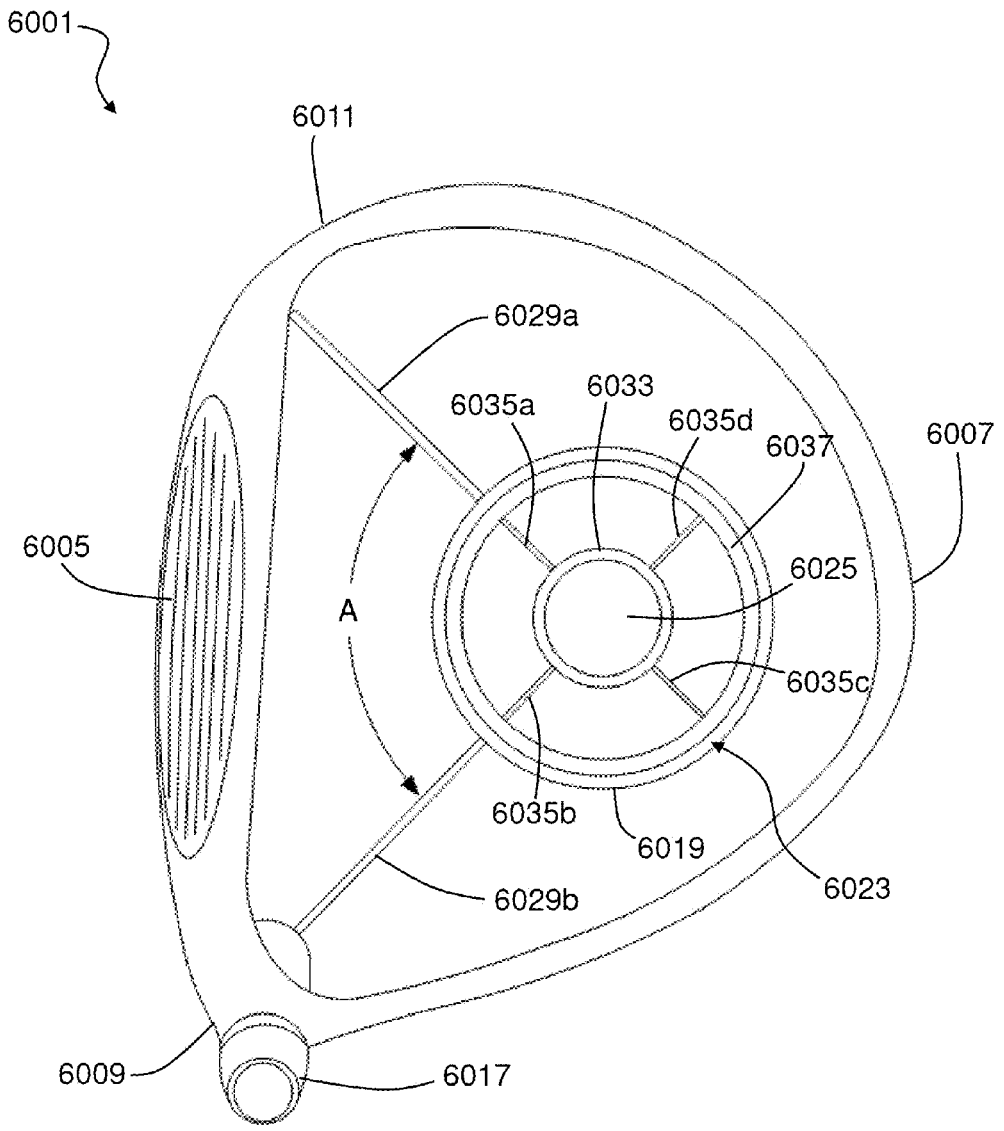

FIGS. 37 and 38 are top perspective views of the club head 6001 with a portion of the crown 6015 removed to illustrate the interior cavity 6027. As shown, the port 6021 is generally circular in shape. However, it should be noted that the port 6021 can be various shapes, contours, geometries, etc. The port body 6023 includes an inner annular wall 6033 serving as a central hub from which a plurality of secondary stiffening elements (hereinafter referred to herein as secondary ribs) 6035 radiate. The port body 6023 further includes an outer annular wall 6037 surrounding the inner wall 6033 and secondary ribs 6035. The outer annular wall 6037 generally defines the outer periphery of the port 6021. As shown, the secondary ribs 6035 are circumferentially spaced between the inner and outer walls 6033, 6037 and equidistantly spaced apart, such that secondary ribs 6035 generally resemble spokes on a wheel. Furthermore, the portion of body 6023 between the inner and outer annular walls 6033, 6037 is solid. In the illustrated embodiment, the port body 6023 includes four secondary ribs 6035*a*, 6035*b*, 6035*c*, and 6035*d*. The four secondary ribs 6035*a*-6035*b* generally radiate equidistantly from the center of the port body 6023, each in a different direction (generally in the form of a cross). The window 6025 is formed within the center of the port body 6023, surrounded by the inner annular wall 6033. The secondary ribs 6035 may provide structural stiffness, vibration damping, and/or sound tuning characteristics.

The main ribs 6029*a*, 6029*b* extend from the port 6021 in a direction towards the face 6005 of the club head 6001. For example, a first main rib 6029*a* extends from the port 6021 towards a portion of the face 6005 adjacent the toe 6011 and a second main rib 6029*b* extends from the port 6021 towards a portion of the face 6005 adjacent the heel 6009. The first and second main ribs 6029*a*, 6029*b* have a converging configuration. For example, the first and second main ribs 6029*a*, 6029*b* generally radiate from the center of the window 6025 within the inner annular wall 6033 of the port body 6023. Accordingly, an angle A is formed between the first and second main ribs 6029*a*, 6029*b*. The angle A between the first and second main ribs 6029*a*, 6029*b*, is in the range of 10 degrees to 170 degrees, but more preferably in the range of 45 degrees to 135 degrees. In one embodiment, angle A is 90 degrees. The value of angle A may have a direct correlation to the location of the port 6021 along the sole 6013 of the club head 6001. For example, as the location of the port 6021 moves closer to the rear 6007 of the club head 6001, angle A will decrease (if the main ribs 6029 are arranged in a converging configuration, as shown). As the location of the port 6021 moves closer to the face 6005 of the club head 6011, angle A will increase.

In some embodiments, the main ribs 6029 may be aligned with some of the secondary ribs 6035 of the port 6021. For example, as shown, the first main rib 6029*a* is generally aligned with a first secondary rib 6035*a* of the port body 6023 and the second main rib 6029*b* is generally aligned with a second secondary rib 6035*b* of the port body 6023. As described in greater detail herein, the main ribs 6029 and the secondary ribs 6035 provide structural stiffness, vibration damping, and/or sound tuning characteristics. Furthermore, placement of the main ribs 6029 near the port 6021, in the manner shown and described herein, results in an increase in the frequency of the port 6021, thereby improving acoustic properties of the club head 6001.

It should be noted that a club head consistent with the present disclosure may include a plurality of main ribs extending from the port 6021 in any direction, and need not be limited to extending towards the face 6005 of the club head 6001. For example, in other embodiments, the club head 6001 may include additional main ribs extending from the port 6021 towards the heel 6009, toe 6011, the rear 6007, or combinations thereof. In one embodiment, the club head 6001 may include four main ribs generally aligned with the four secondary ribs of the port body 6023.

The main ribs 6029 may be formed integral with the sole 6013 and/or any portion of the body 6003 such as by being cast as a unit, or they may be separate components that are coupled to the interior surface of the sole 6013 in a secondary coupling procedure. Alternatively, the main ribs 6029 may be coupled using any coupling technique, such as welding, soldering, brazing, swaging, etc. Additionally, the main ribs 6029 may be removably coupled, or semi-permanently coupled, to the interior surface of the sole 6013 such as by using removable fasteners, or adhesive.

Figure 39:
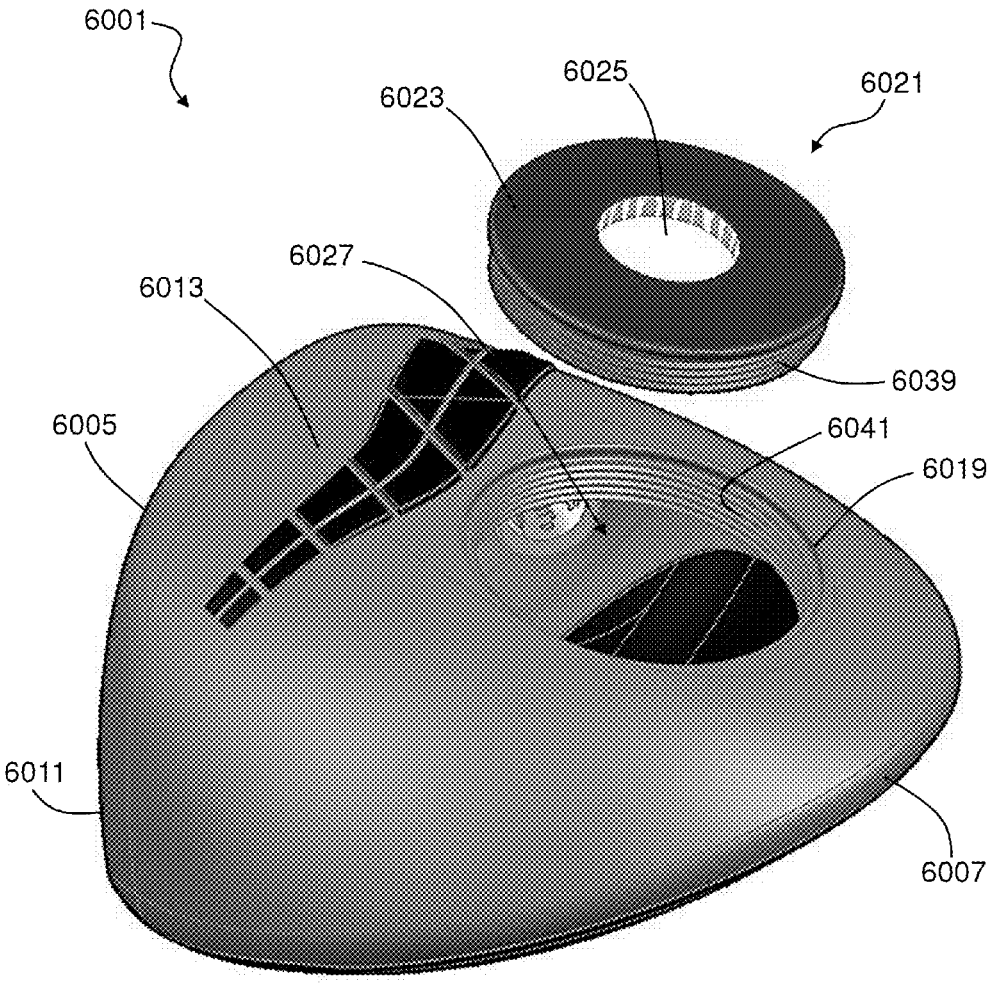
FIG. 39 shows a bottom perspective view of the club head of FIG. 35 with the port disassembled from the mounting portion formed on the sole of the club head.
Figure 40:
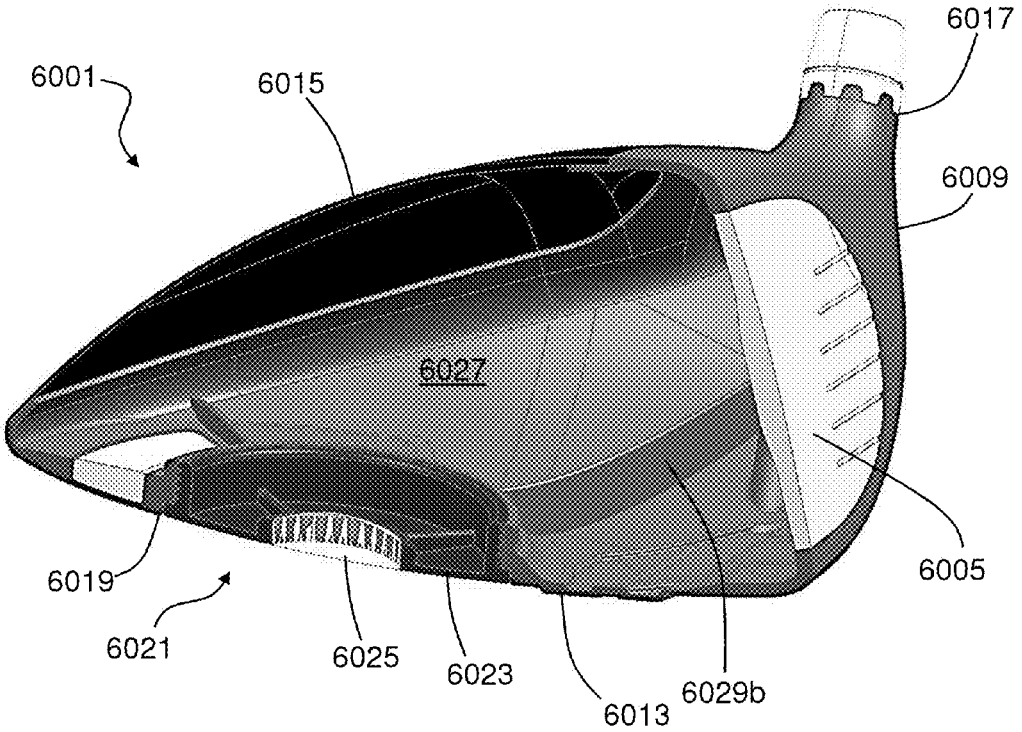
FIG. 40 shows a toe-side perspective view, partly in section, of the club head of FIG. 35.
Figure 41:
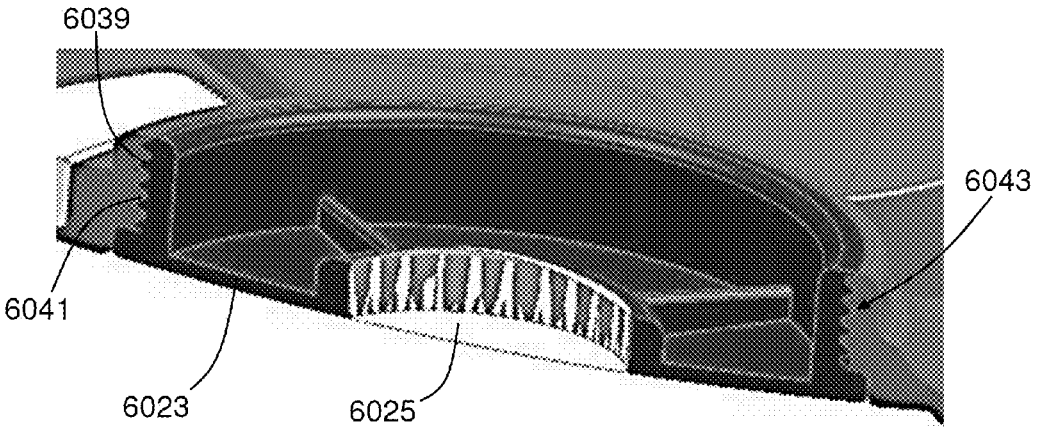
FIG. 41 shows an enlarged perspective view, partly in section, of engagement between the port and the mounting portion.

FIG. 39 shows a bottom perspective view of the club head 6001 with the port 6021 disassembled from the mounting portion 6019 of the sole 6013. The port 6021 may be coupled to the club head 6001 by any known means. In the illustrated embodiment, the port 6021 is coupled to the mounting portion 6019 by way of a threaded engagement. In particular, the outer annular wall 6037 of the port 6021 includes external threads 6039 configured to engage an internally threaded socket, or bore, 6041 of the mounting portion 6019. The threaded engagement, indicated by arrow 6043, is illustrated in FIGS. 40 and 41, which show a toe-side perspective view, partly in section, of the club head 6001. In some embodiments, the internally threaded socket 6041 may be configured to resist loosening of the engagement between the port 6021 and the mounting portion 6019. For example, in one embodiment, the internally threaded socket 6041 may include a self-locking female thread form providing a unidirectional locking feature, such as SPIRALOCK self-locking female thread form offered by Stanley Engineered Fastening (formerly Emhart Teknologies). Additionally, or alternatively, a stopping feature (not shown) may be included so as to prevent over tightening of the port 6021 with the mounting portion 6019, so as to prevent the risk of damage and or stress to the port 6021 and/or mounting portion 6019. The stopping feature could include, for example, a washer or clip positioned over a portion of the externally threaded wall 6037.

In some embodiments, the port 6021 may be permanently coupled to the mounting portion 6019 and fixed to the sole 6013. For example, in addition to the threaded engagement, or alternatively, the port 6021 may be coupled to the mounting portion 6019 via bonding with adhesives or cements, welding (e.g., laser welding), soldering, brazing, or other fusing techniques, etc. In other embodiments, the port 6021 may be removable, thereby providing access to the interior of the club head, in addition to provide an interior view. For example, in the event a golfer wishes to gain access to the interior cavity 6027, the golfer need only unscrew the port 6021 from the mounting portion 6019.

As previously described herein, the port 6021 provides a golfer with a view to the interior cavity 6027 of the club head 6001. Accordingly, in one embodiment, the club head 6001 has a generally clean and finished interior cavity 6027. As such, it will be appreciated that club head construction is devoid of rat glue (aka hot melt), or other adhesives or bonding compounds, that would necessarily result in poor aesthetics, as the interior will be visible via the port 6021. Furthermore, by having an interior that is devoid of adhesives, such as rat glue, a golfer can gain access to the interior and manipulate components within without the consequence of possibly making contact with adhesives, which can be particularly sticky and result in a negative experience for the golfer and cause frustration.

In addition to providing a view of internally placed weights, sound tuning members, and/or adjustment or customization mechanisms, the port 6021 further provides an internal view of any information such as printing, indicia, markings or colorings, etc on the interior cavity 6027 of the club head 6001. For example, different components of the club head (e.g., crown insert, face insert, weights, sound tuning members, etc.) may include identifying markings, indicia, coloring, etc. provided on the interior of the club head. Accordingly, the port 6021 is configured to provide a golfer with a means of viewing this internally presented information. The markings, indicia, coloring may include materials configured to emit light (e.g., phosphorescent materials) so as to improve visibility. Accordingly, in one embodiment, a face insert may include glow-in-the-dark markings on the interior surface providing information related to the face insert (e.g., name of face insert, attributes of face insert, etc.).

Figure 42:
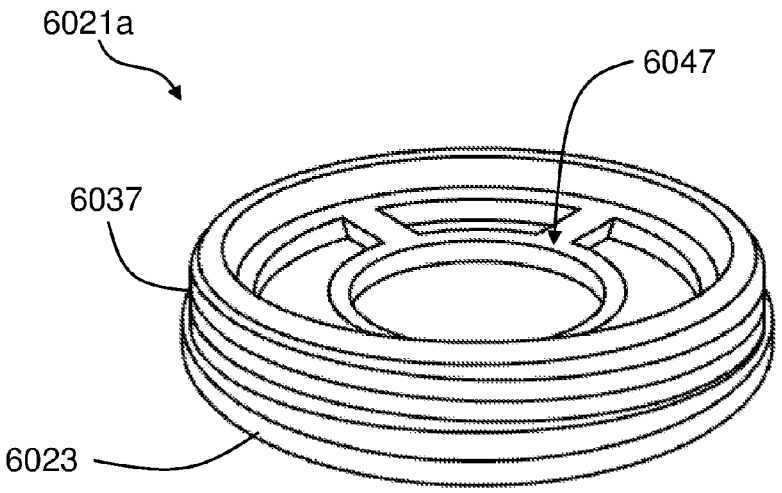
FIG. 42 shows a top perspective view of an alternative embodiment of a port consistent with the present disclosure.
Figure 43:
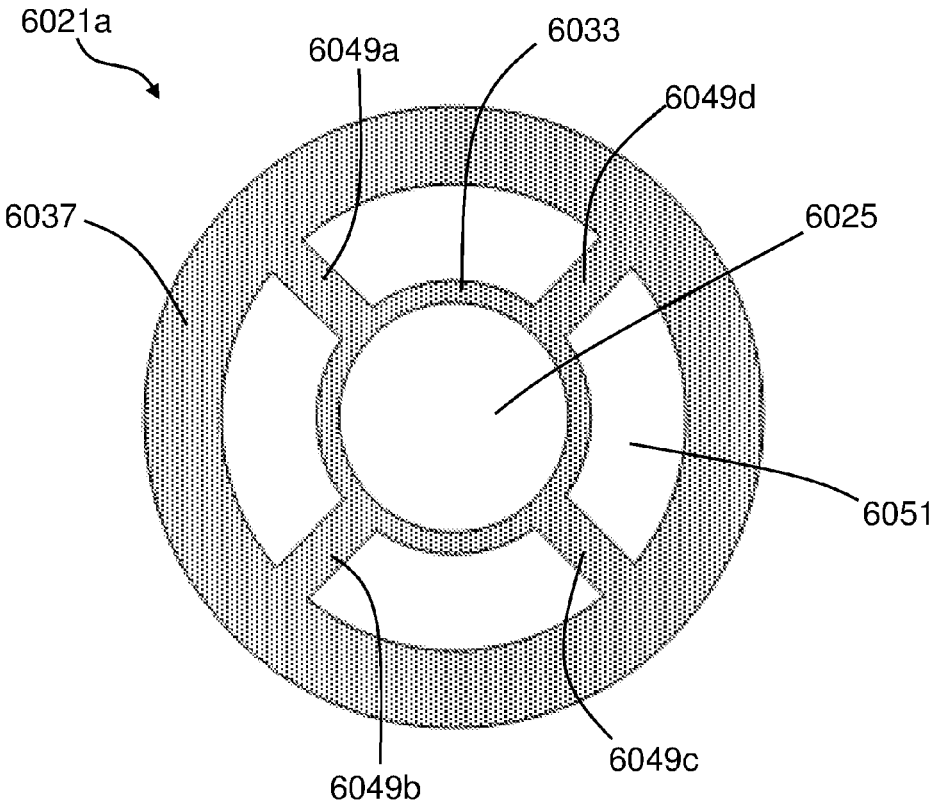
FIG. 43 shows a bottom view of the port of FIG. 42.

FIG. 42 shows a perspective view of an alternative embodiment of a port 6021*a* consistent with the present disclosure. FIG. 43 shows a bottom view of the port of FIG. 42. It should be noted that port 6021*a* is similar to port 6021 and like parts have like reference numerals. As shown, the port 6021*a* has distinct framework 6047 of the body 6023. Similar to the port 6021 previously described herein, port 6021*a* includes an inner annular wall 6033 serving as a central hub from which a plurality of secondary stiffening elements (hereinafter referred to herein as secondary ribs) 6049 radiate. The port framework 6047 further includes an outer annular wall 6037 surrounding the inner wall 6033 and secondary ribs 6049. In the illustrated embodiment, a plurality of windows 6051 are defined between each of the secondary ribs 6049 and the inner and outer annular walls 6033, 6037. Windows 6051 are composed of a similar material as window 6025. Accordingly, the windows 6051 increase the viewing potential of the port 6021*a*.

In some embodiments, the club head 6001 may include multiple ports positioned on different portions of the body 6003. The additional ports may provide additional viewpoints to the interior of the club head, as well as allow additional ambient light to enter the interior, thereby improving visibility.

Figure 44:
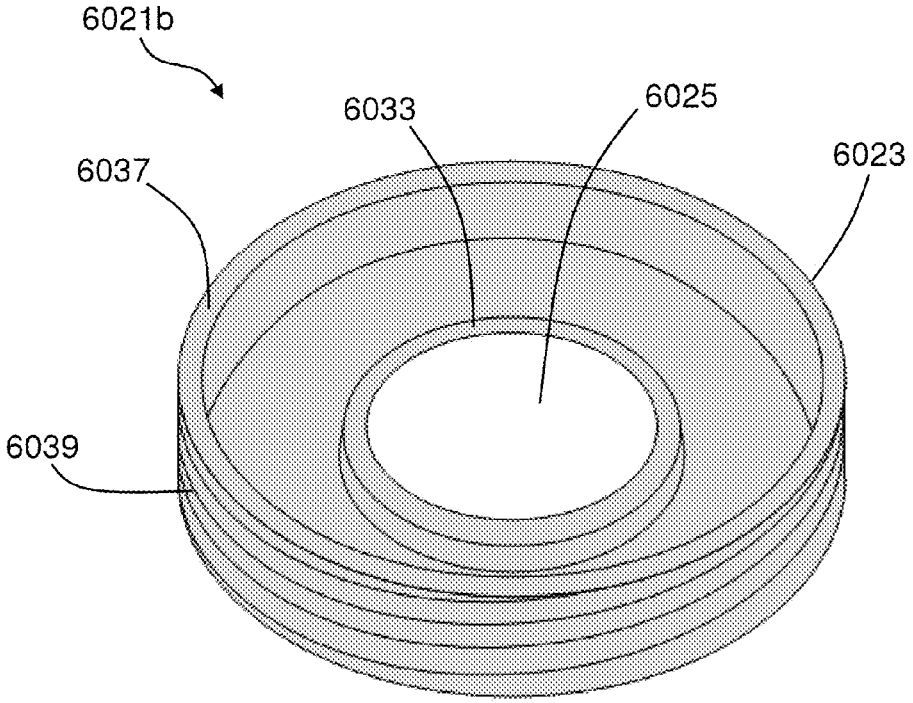
FIG. 44 shows a perspective view of an alternative embodiment of a port consistent with the present disclosure.
Figure 45:
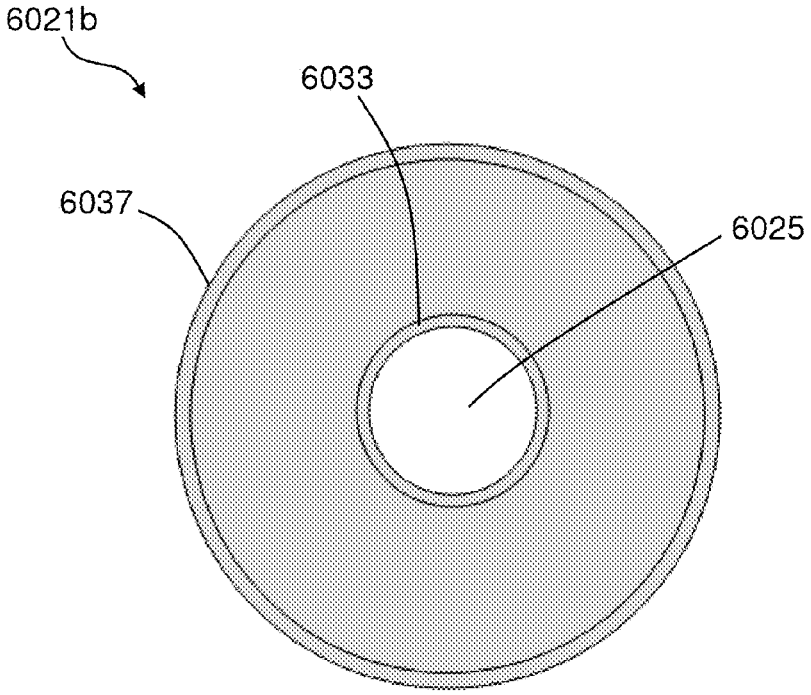
FIG. 45 shows a top view of the port of FIG. 44

FIG. 44 shows a perspective view of an alternative embodiment of a port 6021*b* consistent with the present disclosure. FIG. 45 shows a top view of the port 6021*b*. It should be noted that port 6021*b* is similar to port 6021 and like parts have like reference numerals. As shown, the port 6021*b* includes a body 6023 having an inner annular wall 6033 and an outer annular wall 6037 having an externally threaded surface 6039. The window 6025 is defined within the port body 6023, substantially surrounded by the inner annular wall 6033. Unlike port 6021, the illustrated port 6021*b* is devoid of any secondary ribs positioned between the inner and outer annular walls 6033, 6037. The portion of the body 6023 between the inner and outer annular walls 6033, 6037 is substantially solid.

It should be noted that, in some embodiments, a port consistent with the present disclosure may be devoid of a window and may include a substantially opaque body 6023. Such a port may provide an outer surface suitable for application of a painting, marking, indicia, engraving, embossing, decal, and combinations thereof. Furthermore, such a port may be releasably couplable to the golf club head, such that the port serves as a means of accessing the interior of the club head, rather than providing a view into the interior.

Additionally, or alternatively, a port consistent with the present disclosure may further provide mass to the golf club head, essentially serving as a removable weight. For example, the port can be any material of a desired density for providing different performance characteristics of the golf club head. Accordingly, ports of different densities may be interchangeable with one or more mounting portions on the golf club head, thereby providing a golfer with a means of adjusting the performance characteristics of the club head (e.g., center of gravity, moment of inertia, swingweight, etc.). In certain embodiments, different ports may have different masses by having differing densities in their constituent materials. For example, one port may be made with metals or other materials of different densities (e.g., some tungsten, some aluminum, etc.). Furthermore, in some embodiments, the club head may include multiple mounting portions positioned along different portions of the club head body. A golfer can customize the performance characteristics of the club head based on a particular arrangement of ports coupled to the different mounting portions.

Every golf club produces a distinct sound and feel when it is used to strike a golf ball. The sound and feel are produced by the vibration behavior of the golf club head which is a result of the design of the golf club head. Golf club head designs are analyzed and samples are tested to characterize the vibration characteristics of a particular design in an attempt to determine whether the sound and feel produced by the golf club head will be acceptable to the average golfer. In particular, the frequency values and displacement shapes are determined for the various vibration modes of the club head. It is generally understood that the lower frequency modes, especially those at frequencies below about 3500 Hz, have a tendency to detrimentally affect the sound and feel of a particular golf club head.

As described herein, golf club head 6001 includes structural features (e.g., main and secondary ribs) that tune the sound of the golf club head by manipulating the frequency and displacement shape of the vibration modes. Generally, vibration mode frequencies of less than about 3500 Hz are undesirable, so it is desirable to include such structural features so that the first vibration mode is at a frequency greater than about 3500 Hz. In particular, the main ribs 6029 are configured to manipulate the vibration modes of the club head by altering the vibration behavior of the golf club head. The main ribs 6029 are positioned at areas at or adjacent to one or more hot spots in the vibration mode. As used herein, hot spots are localized areas of the structure that exhibit increased displacement at the frequency of the vibration mode. For each vibration mode there is generally a primary hot spot that exhibits maximum displacement over the structure for that vibration mode. Some vibration modes also exhibit secondary and/or tertiary hot spots that exhibit local maximum displacement, but with a displacement magnitude that is less than that of the primary hot spot.

Figure 46A:
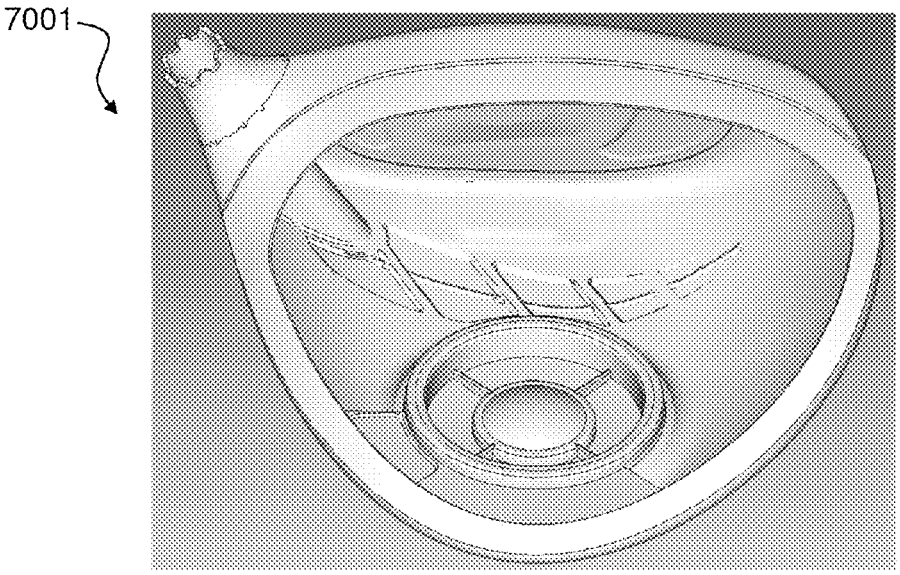
FIG. 46A shows a perspective view of a golf club head without stiffening elements formed along an interior surface of the sole and further including a sole port.
Figure 46B:
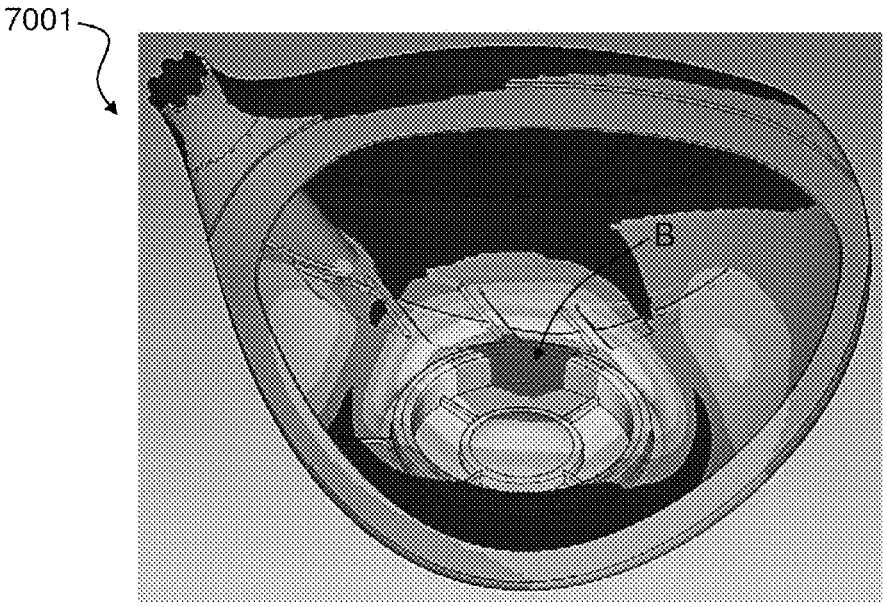
FIG. 46B illustrates the topography of a vibration mode of the club head of FIG. 46A.

FIG. 46A is a perspective view of a golf club head 7001 having a port and being without main ribs formed along an interior surface of the sole adjacent to the port. The golf club head 7001 was analyzed using finite element analysis (FEA) and the lowest frequency vibration mode (i.e., first mode) was determined to be as illustrated in FIG. 46B. In that instance, the modeled golf club head exhibited a first mode having a frequency of about 3386 Hz, which results in an unfavorable sound upon impact of the club head with a ball (3386 Hz is less than benchmark of 3500 Hz). The location of maximum displacement of that vibration mode, i.e., the primary hot spot, was determined to be approximate to the port 6021 on the sole of the club head 7001, as indicated by arrow B.

Figure 47A:
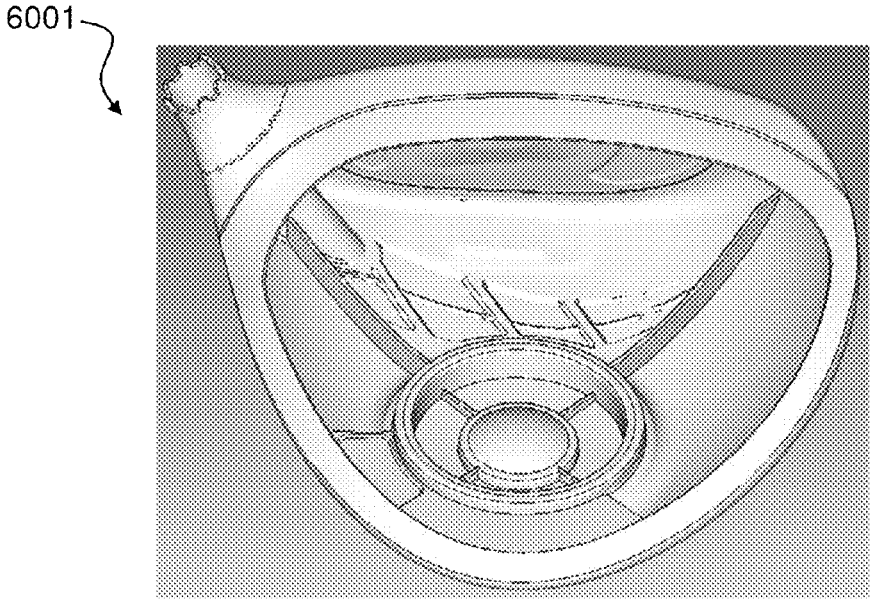
FIG. 47A shows a perspective view of the golf club head of FIG. 35 including a sole port and stiffening elements formed along an interior surface of the sole.
Figure 47B:
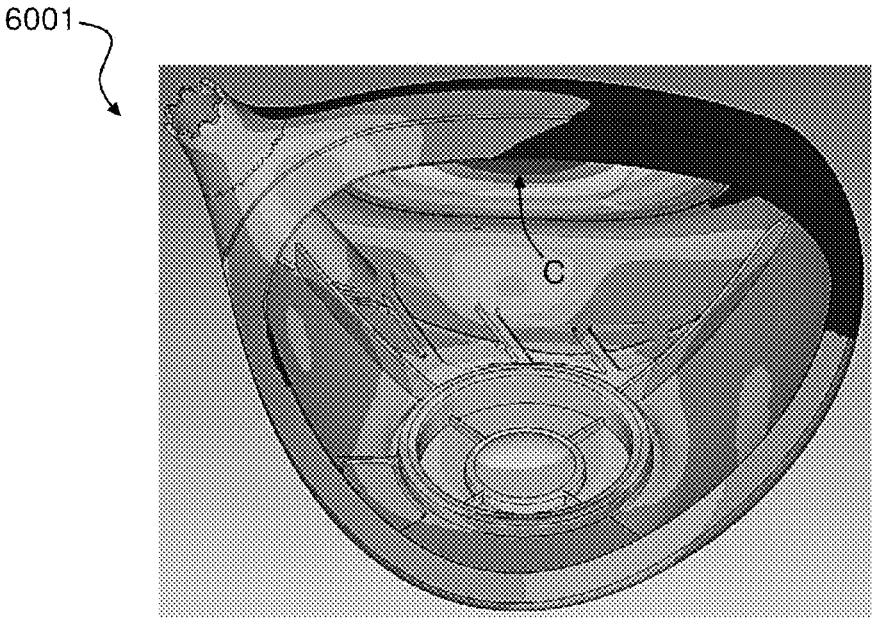
FIG. 47B illustrates the topography of a vibration mode of the club head of FIG. 47A.

FIG. 47A shows a perspective view of the golf club head 6001 including the port and main ribs positioned on the internal surface of the sole and extending from the port to the face of the club head. The golf club head 6001 was analyzed using FEA and the lowest frequency vibration mode was determined to be as illustrated in FIG. 47B. In that instance, the modeled golf club head exhibited a mode having a frequency of about 3848 Hz, which results in a very favorable sound (3848 Hz is greater than benchmark of 3500 Hz). The location of maximum displacement of that vibration mode, i.e., the primary hot spot, was determined to be on the face of the club head 6001, as indicated by arrow C.

Accordingly, the addition of the main ribs increased the frequency of the first mode of the analytical model to a value (e.g., 3848 Hz) greater than 3500 Hz, the desired frequency for producing a distinct and pleasant sound upon impact. Thus, inclusion of the main ribs on the interior surface of the sole and adjacent to the port, in conjunction with the port configuration of the port (spoked wheel design), provides sound tuning characteristics, resulting in an increase of the frequency of the port, thereby improving acoustic properties of the club head 6001.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a club head body comprising a heel, a toe, a sole, a crown, and a ball-striking face; and at least one port that is configured to be removed from and re-attached to a mounting portion on the club head body, the at least one port comprising:

a body having an inner annular wall and an outer annular wall surrounding the inner annular wall, the outer annular wall has a threaded external surface configured to engage internal threading on the mounting portion of the club head body; and a window portion;

wherein the at least one port is configured to provide a view from the exterior of the club head into an interior cavity of the club head body when attached to the mounting portion; and wherein an interior surface of at least the sole, the crown, and the ball-striking face within the interior cavity of the club head body are accessible when the at least one port is removed from the mounting portion of the club head body.

2. The golf club head of claim 1, further comprising at least one rib positioned on an internal surface of the interior cavity of the club head and having at least a first end adjacent to the port.

3. The golf club head of claim 2, wherein the at least one rib is configured to provide sound tuning characteristics for the golf club head.

4. The golf club head of claim 3, wherein the at least one rib is configured to increase a vibration frequency value of an area adjacent the port to improve an acoustic property of the club head.

5. The golf club head of claim 4, wherein the acoustic property is a sound produced by the golf club head during impact between the ball-striking face and a ball.

6. The golf club head of claim 1, wherein the mounting portion is on the sole of the club head body.

7. The golf club head of claim 1, wherein the window portion lies within and is surrounded by the inner annular wall, the window portion comprising a transparent or translucent material configured to provide a view into the interior cavity of the club head body.

8. The golf club head of claim 1, wherein the interior cavity includes at least one feature selected from the group consisting of: a mass adjustment mechanism configured for adjusting a mass distribution of the club head body; a sound tuning member for adjusting sound properties of the club head; informative data provided in the form of a painting, marking, indicia, engraving, embossing, and decal; and one or more electronic devices positioned within the club head body for collecting information related to the club head body and/or club head performance.

9. A golf club head comprising:

a club head body comprising a heel, a toe, a sole, a crown, and a ball-striking face; and at least one port that is configured to be removed from and re-attached to a mounting portion on the sole of the club head body, the at least one port comprising:

a body portion having an inner annular wall and an outer annular wall surrounding the inner annular wall, the outer annular wall has a threaded external surface configured to engage internal threading on the mounting portion; and a window portion comprising a transparent or translucent material configured to provide a view from the exterior of the club head into an interior cavity of the club head body when the at least one port is attached to the mounting portion; and at least a first rib positioned on an internal surface of the sole and extending from the port towards a perimeter of the club head body, wherein an interior surface of at least the sole, the crown, and the ball-striking face within the interior cavity of the club head body are accessible when the at least one port is removed from the mounting portion on the sole of the club head body.

10. The golf club head of claim 9, wherein the first rib extends from the port towards a portion of the face adjacent to the toe of the club head body and a second rib extends from the port towards a portion of the face adjacent to the heel of the club head body.

11. The golf club head of claim 10, wherein the first and second ribs radiate from the outer annular wall of the port, defining an angle there between.

12. The golf club head of claim 11, wherein the angle between the first and second ribs is in the range of 10 degrees and 170 degrees.

13. The golf club head of claim 12, wherein the angle between the first and second ribs is in the range of 45 degrees and 135 degrees.

14. The golf club head of claim 13, wherein the angle between the first and second ribs is 90 degrees.

15. The golf club head of claim 10, wherein the first and second ribs are aligned in a converging configuration.

16. The golf club head of claim 9, wherein the first rib is configured to provide sound tuning characteristics for the golf club head.

17. The golf club head of claim 16, wherein the first rib is configured to increase a vibration frequency value of an area adjacent the port to improve an acoustic property of the club head.

* * * * *